US009073066B2

(12) United States Patent
Banks et al.

(10) Patent No.: US 9,073,066 B2
(45) Date of Patent: Jul. 7, 2015

(54) FOAM DISPENSER

(71) Applicant: PIBED LIMITED, Ripley, Derbyshire (GB)

(72) Inventors: Stewart Banks, Alfanzina Near Carvoiro (PT); Christopher James Lang, Nottingham (GB); Dean Philip Limbert, Derby (GB); David Michael Ross Creaghan, Derby (GB)

(73) Assignee: PIBED LIMITED, Denby, Ripley, Derbyshire (GB)

( * ) Notice: Subject to any disclaimer, the term of this patent is extended or adjusted under 35 U.S.C. 154(b) by 0 days.

(21) Appl. No.: 14/383,388

(22) PCT Filed: Apr. 2, 2013

(86) PCT No.: PCT/EP2013/056901

§ 371 (c)(1),
(2) Date: Sep. 5, 2014

(87) PCT Pub. No.: WO2013/160071

PCT Pub. Date: Oct. 31, 2013

(65) Prior Publication Data

US 2015/0034678 A1 Feb. 5, 2015

Related U.S. Application Data

(63) Continuation of application No. 13/458,318, filed on Apr. 27, 2012, now Pat. No. 8,814,005.

(51) Int. Cl.
*B67D 7/76* (2010.01)
*B05B 7/00* (2006.01)
(Continued)

(52) U.S. Cl.
CPC ..... *B05B 7/005* (2013.01); *B05B 7/0025* (2013.01); *B05B 7/0416* (2013.01); *B05B 11/007* (2013.01);
(Continued)

(58) Field of Classification Search
CPC ..... A47K 5/14; A47K 5/1204; B05B 7/005; B05B 7/0018; B05B 7/0037; B05B 7/0416; B05B 11/02; B05B 11/30; B05B 11/3001; B05B 11/3015; B05B 11/3028; B05B 11/3087; B01F 3/04992; B01F 3/04446
USPC ..... 222/190, 145.5, 145.6, 207, 211, 136, 222/137, 385, 373
See application file for complete search history.

(56) References Cited

U.S. PATENT DOCUMENTS 2,183,561 A 12/1939 Hamblin
3,452,905 A * 7/1969 Micallef ..... 222/207
(Continued)

FOREIGN PATENT DOCUMENTS

CN 2406734 11/2000
CN 2494235 6/2002
(Continued)

*Primary Examiner* — J. Casimer Jacyna
*Assistant Examiner* — Benjamin R Shaw
(74) *Attorney, Agent, or Firm* — Hill & Schumacher

(57) ABSTRACT

A foam assembly connectable to a liquid container includes a main pump body, a resiliently deformable piston dome, an air chamber, a liquid chamber, a mixing zone and a porous member. The main pump body has an exit nozzle with the porous member therein. The air chamber and the liquid chamber are each defined by the piston dome and the main pump body. The liquid chamber has a liquid inlet valve and a liquid outlet valve. The mixing zone is in flow communication with the air chamber and the liquid chamber. The volume of the air chamber and the liquid chamber are each dependent on the position of piston dome and during an activation stroke the piston moves from the at rest position to the depressed position and responsively the volume of the air chamber and the volume of the liquid chamber are reduced.

32 Claims, 28 Drawing Sheets

(51) Int. Cl.

| | |
|---|---|
| ***B05B 11/00*** | (2006.01) |
| ***B01F 5/04*** | (2006.01) |
| ***B01F 3/04*** | (2006.01) |
| *B05B 7/04* | (2006.01) |

(52) U.S. Cl.

CPC ..... *B05B 11/3015* (2013.01); *B05B 11/3028* (2013.01); *B05B 11/3052* (2013.01); *B05B 11/3069* (2013.01); *B05B 11/3077* (2013.01); *B05B 11/3087* (2013.01); *B01F 5/0478* (2013.01); *B01F 3/04446* (2013.01); *B01F 3/04503* (2013.01); *B01F 3/04992* (2013.01)

(56) References Cited

U.S. PATENT DOCUMENTS

| | | | | |
|---|---|---|---|---|
| 4,155,487 | A * | 5/1979 | Blake | 222/207 |
| 4,880,161 | A * | 11/1989 | Wright | 239/330 |
| 5,100,029 | A | 3/1992 | Meshberg | |
| 5,445,288 | A * | 8/1995 | Banks | 222/95 |
| 2002/0130198 | A1 * | 9/2002 | Bennett | 239/343 |
| 2004/0149777 | A1 * | 8/2004 | Santagiuliana | 222/190 |
| 2005/0247737 | A1 * | 11/2005 | Armstrong | 222/214 |
| 2009/0120966 | A1 * | 5/2009 | Limbert | 222/190 |
| 2009/0206109 | A1 * | 8/2009 | Santagiuliana | 222/190 |
| 2010/0012680 | A1 * | 1/2010 | Canfield et al. | 222/207 |
| 2010/0200615 | A1 * | 8/2010 | Ciavarella | 222/190 |
| 2011/0084099 | A1 * | 4/2011 | Carta | 222/212 |
| 2012/0091229 | A1 * | 4/2012 | Laidler et al. | 239/330 |

FOREIGN PATENT DOCUMENTS

| | | | |
|---|---|---|---|
| CN | 2724849 | | 9/2005 |
| JP | H04 187256 | A | 7/1992 |
| WO | 2011/064584 | A1 | 6/2011 |
| WO | WO 2011064584 | A1 * | 6/2011 |

* cited by examiner

FOAM DISPENSER

CROSS-REFERENCE TO RELATED APPLICATIONS

This application is a National Phase application claiming the benefit of PCT/EP2013/056901 filed on Apr. 2, 2013, in English, which further claims priority to U.S. Utility patent application Ser. No. 13/458,318 filed on Apr. 27, 2012, titled "A FOAM DISPENSER", the entire contents of which are incorporated herein by reference.

BACKGROUND

This disclosure relates to foam dispensers and in particular to dispensers that may have a resiliently deformable dome piston and dispensers that may have an improved mixing chamber.

The present disclosure relates to foam dispensers and more specifically non-aerosol foam dispensers or unpressurized foam dispensers. The popularity of these type of foam dispensers has increased dramatically over the last decade and they are now used widely throughout the world. The advantage of foam dispensers over conventional liquid dispensers is that they use substantially less liquid for each use or shot. For example if the foam dispenser is being used for hand hygiene either as a soap dispenser or an alcohol foam dispenser, each hand cleansing event uses substantially less liquid than would be used with a straight liquid dispenser.

However, there are always opportunities for reducing the cost of production, whether that be by way of reducing the number of parts or simplifying the manufacturing process. As well there are opportunities for improving the quality of the foam or in the alternative producing a commercially acceptable foam in a device that may be produced at a reduced cost.

SUMMARY

A foam assembly connectable to a liquid container includes a main pump body, a piston dome, an air chamber, a liquid chamber, a mixing zone and a porous member. The main pump body has an exit nozzle. The piston dome is attached to the main pump body, whereby the piston dome is a resiliently deformable piston dome and has an at rest position and a depressed position. The air chamber is defined by the piston dome and the main pump body. The liquid chamber is defined by the piston dome and the main pump body and has a liquid inlet valve and a liquid outlet valve. The mixing zone is in flow communication with the air chamber and is in flow communication with the liquid chamber. The porous member is in the exit nozzle downstream of the mixing zone. The volume of the air chamber and volume of the liquid chamber is dependent on the position of piston dome and during an activation stroke the piston moves from the at rest position to the depressed position and responsively the volume of the air chamber and the volume of the liquid chamber are reduced.

A foam dispenser includes a liquid container; a main pump body, a piston dome, an air chamber, a liquid chamber, a mixing zone and a porous member. The main pump body has an exit nozzle. The piston dome is attached to the main pump body, whereby the piston dome is a resiliently deformable piston dome and has an at rest position and a depressed position. The air chamber is defined by the piston dome and the main pump body. The liquid chamber is defined by the piston dome and the main pump body and has a liquid inlet valve and a liquid outlet valve. The mixing zone is in flow communication with the air chamber and is in flow communication with the liquid chamber. The porous member is in the exit nozzle downstream of the mixing zone. The volume of the air chamber and volume of the liquid chamber is dependent on the position of piston dome and during an activation stroke the piston moves from the at rest position to the depressed position and responsively the volume of the air chamber and the volume of the liquid chamber are reduced.

The main pump body may include a main pump body portion and a liquid and air bore. The liquid inlet valve may be integrally formed in the liquid and air bore. The liquid and air bore may further include an air path integrally formed therein wherein the air path extends between the air chamber and the mixing zone.

The foam assembly may further include an air inlet valve in flow communication with the liquid container. The air inlet valve may be integrally formed in the liquid and air bore.

The mixing zone may include an elongate mixing channel and the mixing channel may have an upstream end and a downstream end and the liquid chamber may be in flow communication with the upstream end of mixing channel via the liquid outlet valve. The foam assembly may further include a chamfer at the downstream end of the mixing channel whereby the chamfer expands in a downstream direction. The mixing channel may further include a plurality of air ports spaced downstream from the upstream end of the mixing channel.

The foam assembly may further include a mixing tube and the mixing channel and chamfer may be formed in the mixing tube. Further the air ports may also be formed in the mixing tube. There may be a plurality of air ports. The plurality of air ports may be four air ports equally spaced around the mixing channel. The plurality of air ports may be two air ports equally spaced around the mixing channel.

The foam assembly may further include one foam tube wherein the foam tube has a porous member attached to one end thereof. The foam tube may have a second porous member attached to the other end thereof. The foam assembly may further include a second foam tube wherein the second foam tube has a porous member attached to one end thereof.

The liquid container may be an upright liquid container, an inverted liquid container, an inverted pouch, or an upright pouch.

The mixing zone may include at least one air port upstream of the elongate mixing channel.

The foam dispenser may include a dispenser housing having a push bar for engaging the piston dome.

A mixing tube for use in a foam assembly having an air chamber and a liquid chamber and a means for pressurizing the air chamber and the liquid chamber includes an elongate mixing channel and an exit zone. The elongate mixing channel has an upstream end and a downstream end. The exit zone is at the downstream end of the mixing channel whereby the exit zone chamfer expands in a downstream direction.

The exit zone may be a chamfer that expands in a downstream direction.

The elongate mixing channel and the exit zone may form an elongate venturi tube.

The mixing tube may include at least one air port in the elongate mixing channel and the air port is in flow communication with the air chamber.

The air port may be a plurality of air ports spaced around the mixing channel.

A foam assembly connectable to a liquid container includes a pump, a mixing zone and a porous member. The pump has an air chamber and a liquid chamber. The pump has an activation stroke wherein the pump moves from an at rest position to a compressed position and a return stroke wherein the pump moves from the compressed position to an at rest position. The volume of the air chamber and liquid chamber are each substantially smaller in the compressed position. The mixing zone is in flow communication with the air chamber and in flow communication with the liquid chamber. The mixing zone has an elongate mixing channel having a cross sectional area and an exit zone downstream of the elongate mixing channel. The exit zone has a cross sectional area larger than the mixing channel cross sectional area. The porous member is downstream of the mixing zone.

The exit zone may be a chamfer that expands in a downstream direction.

The elongate mixing channel and the exit zone together may form an elongate venturi tube.

At least one air port may be formed in the elongate mixing channel and each air port is in flow communication with the air chamber. The at least one air port may be a plurality of air ports spaced around the elongate mixing channel.

The volume of the liquid chamber to the air chamber may be between 1:2 and 1:50.

The volume of the liquid chamber to the air chamber may be between 1:8 and 1:9

Further features will be described or will become apparent in the course of the following detailed description.

BRIEF DESCRIPTION OF THE DRAWINGS

The foam dispenser and improved mixing chamber will now be described by way of example only, with reference to the accompanying drawings, in which.

DETAILED DESCRIPTION

Figure 1:
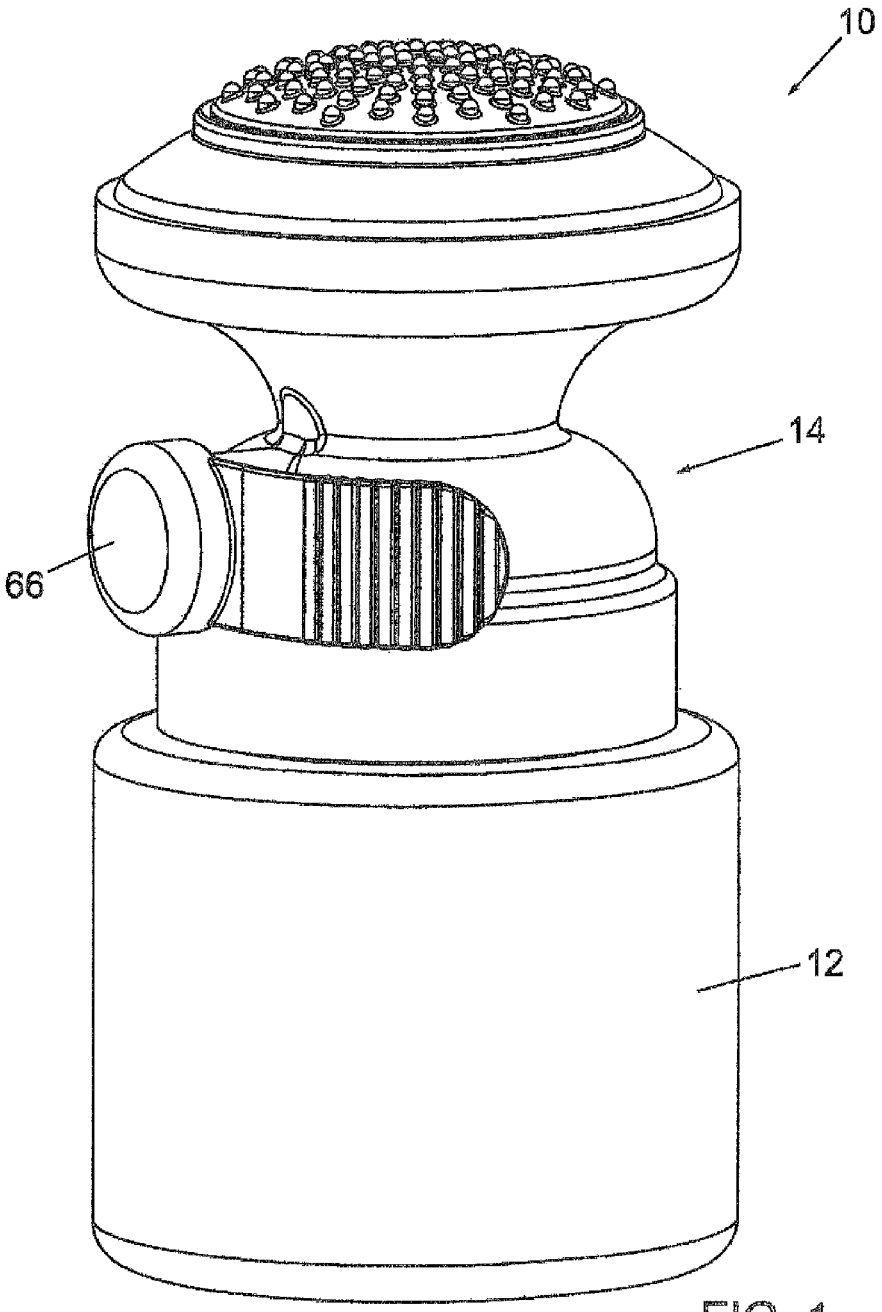
FIG. 1 is a perspective view of an embodiment of a foam dispenser.
Figure 2:
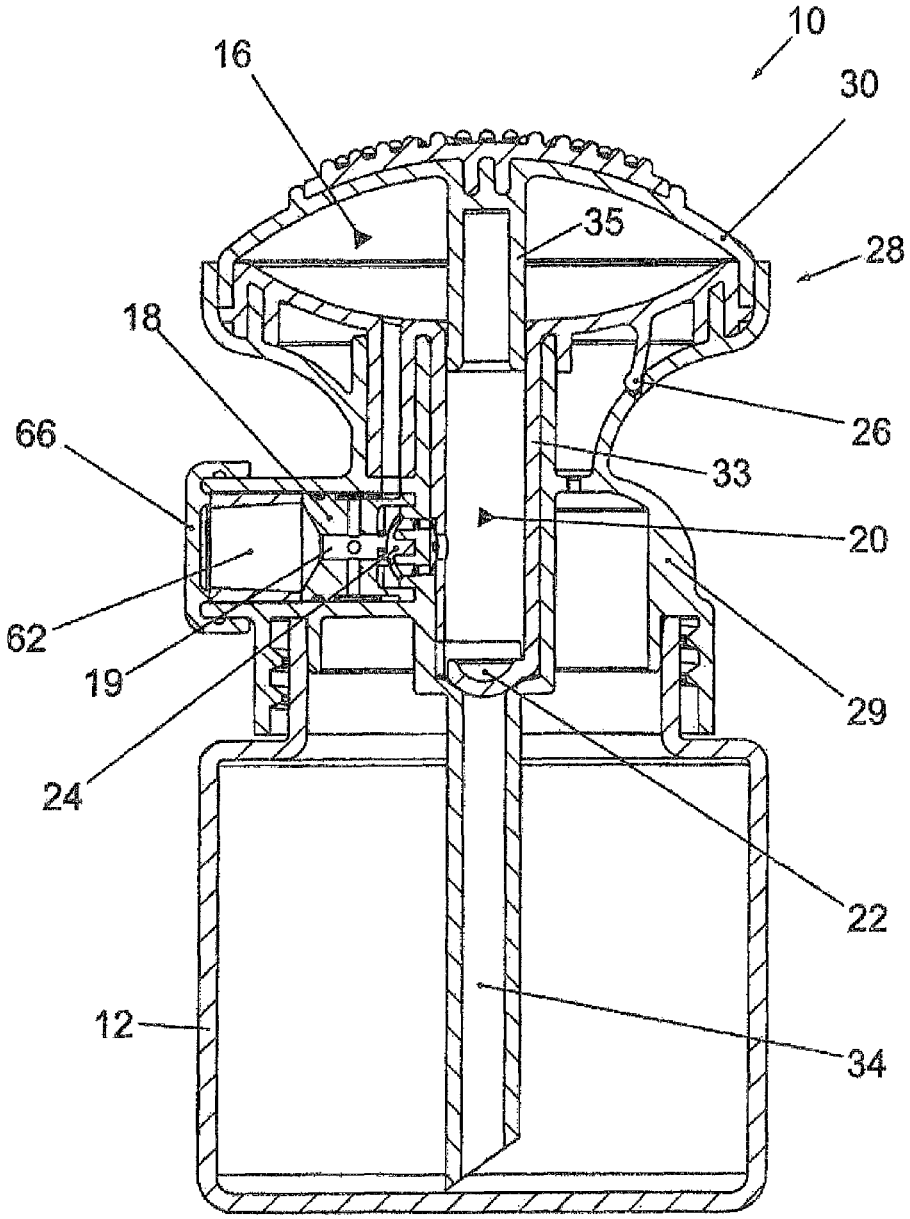
FIG. 2 is a sectional view of the foam dispenser of FIG. 1.
Figure 3:
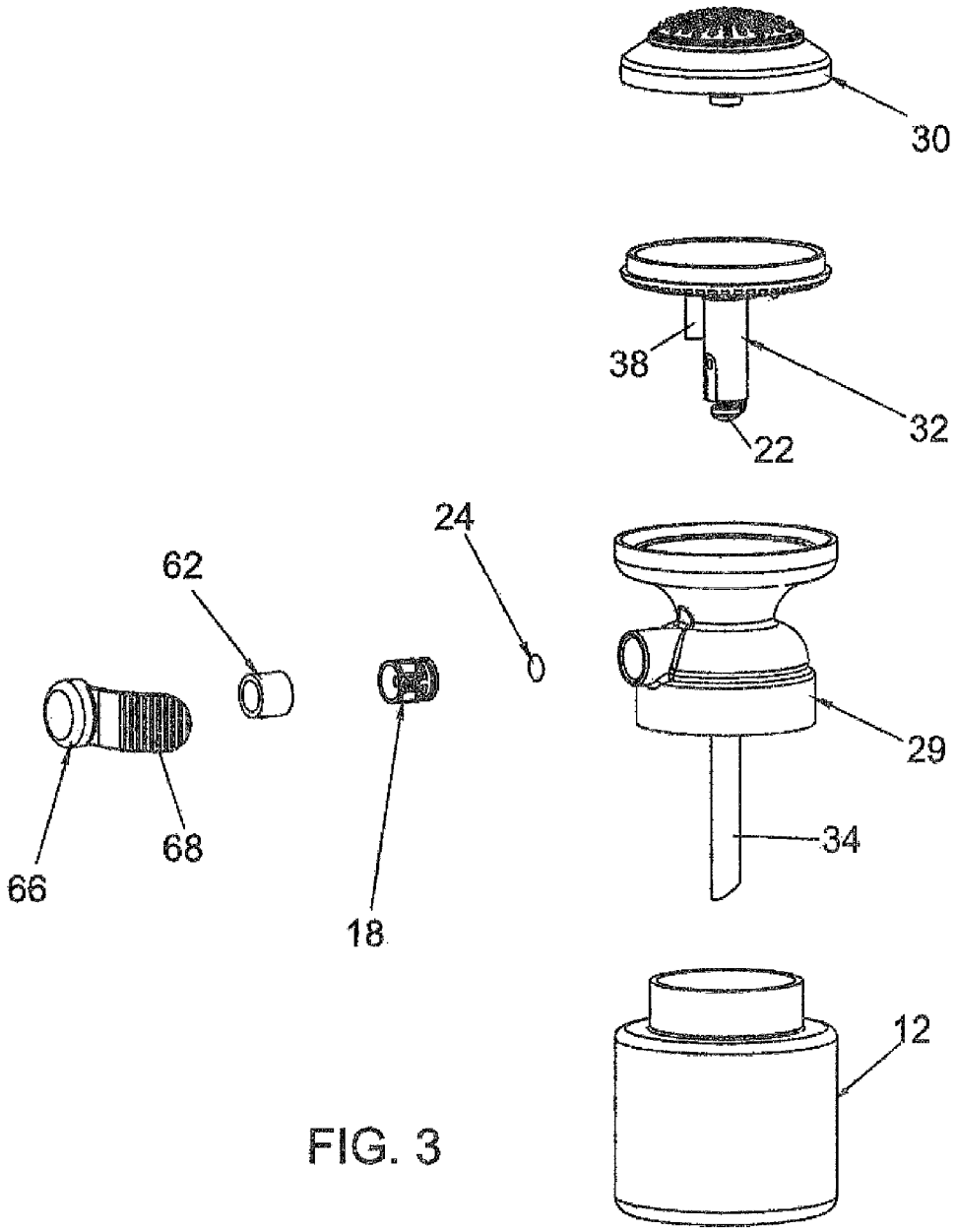
FIG. 3 is a blown apart perspective view of the foam dispenser of FIGS. 1 and 2.

Referring to FIGS. 1, 2 and 3, an embodiment of a foam dispenser is shown generally at 10. Dispenser 10 includes a liquid container 12 and a foaming assembly 14. For reference upstream and downstream are determined during an activation stroke and therefore upstream is where the liquid starts in the liquid container 12 and downstream is where it ends and exits the foam dispenser 10 from the exit nozzle 44. The activation stroke is when the pump or piston dome 30 is depressed and the return stroke is when the piston dome or pump returns to its at rest position.

The pump has an activation stroke wherein the pump moves from an at rest position to a compressed position and a return stroke wherein the pump moves from the compressed position to an at rest position. The volume of the air chamber and liquid chamber are each substantially smaller in the compressed position. The foaming assembly 14 has an air chamber 16 in flow communication with a mixing zone 19 and a liquid chamber 20 in flow communication with the mixing zone 19. The liquid chamber 20 is in flow communication with the liquid container 12 and has a liquid inlet valve 22. A liquid outlet valve 24 is between the liquid chamber and the mixing zone 19.

Figure 4:
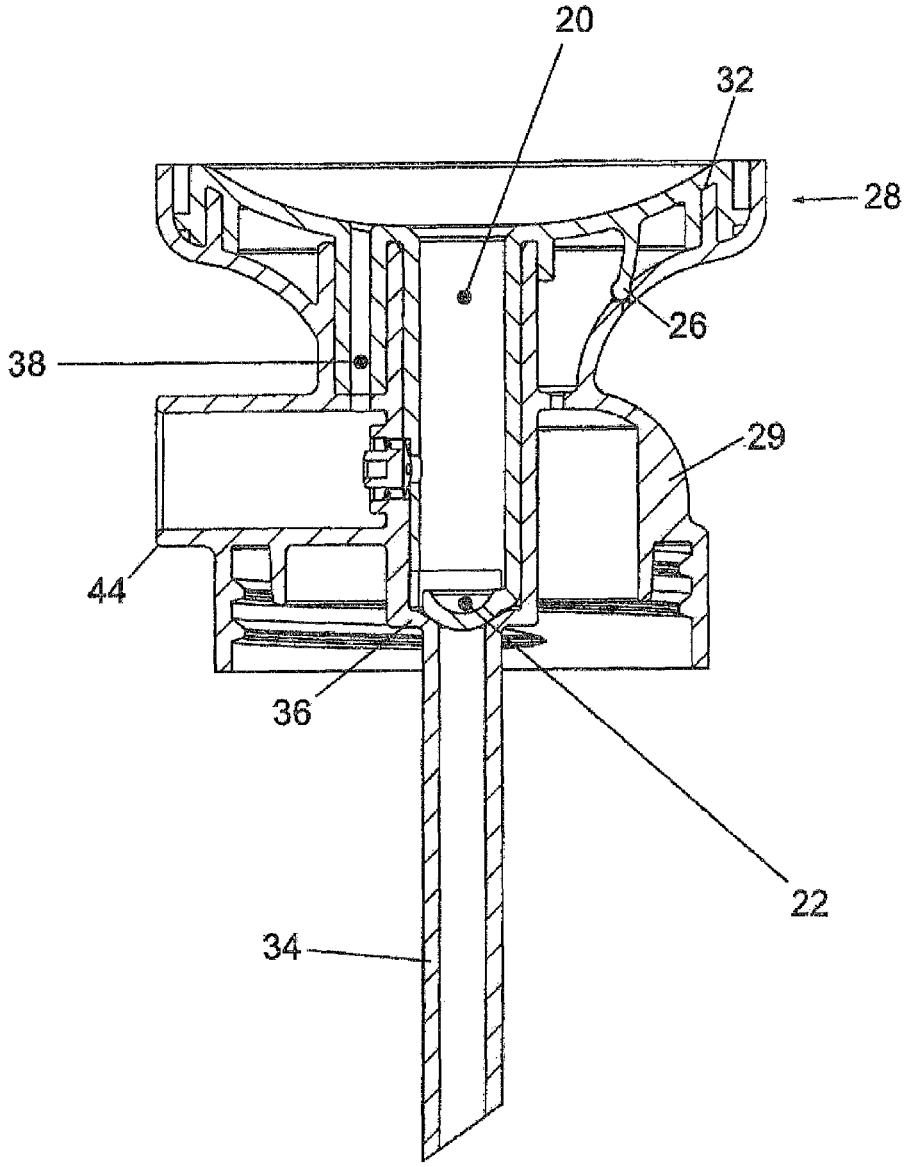
FIG. 4 is a sectional view of the assembled pump body including a main pump body portion and a liquid and air bore of the foam dispenser.
Figure 5:
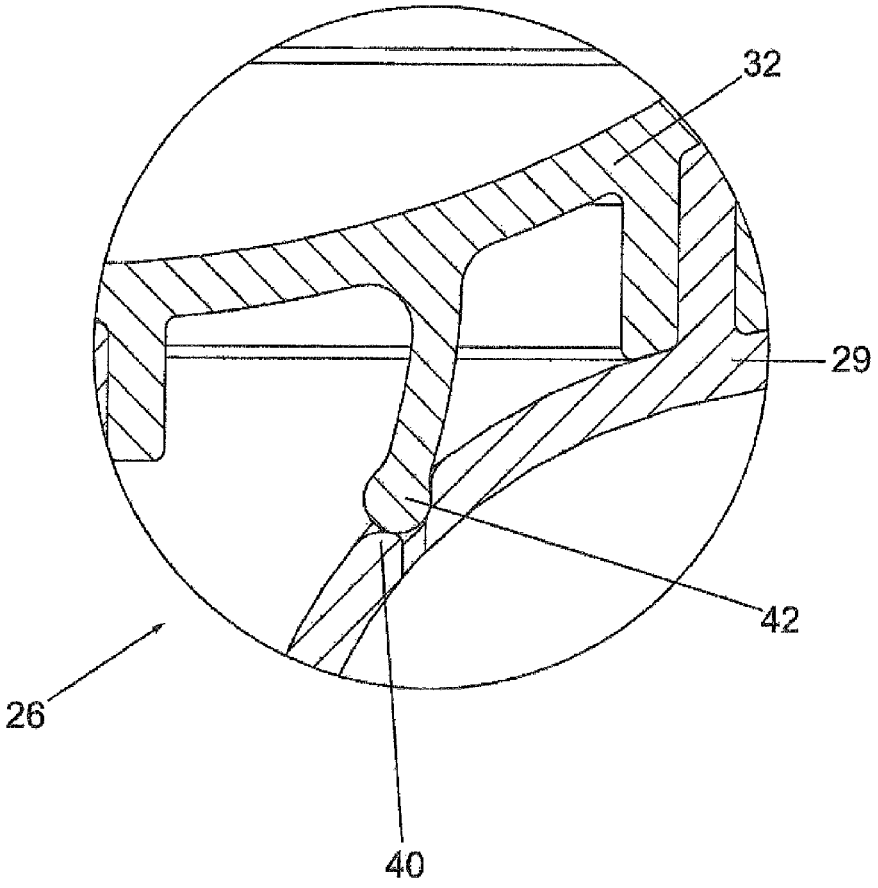
FIG. 5 is an enlarged sectional view of a portion of the assembled pump body including a main pump body portion and a liquid and air bore showing the air inlet valve.

In one embodiment the foaming assembly 14 includes a main pump body 28 and a piston dome 30. The main pump body 28 includes a liquid and air bore 32 which is a press fit into the main pump body portion 29, as best seen in FIG. 4. The liquid and air bore 32 of the main pump body 28 and the piston dome together define the liquid chamber 20 and has the liquid inlet valve 22 integrally formed therein which include a body liquid chamber portion 33 and a liquid piston portion 35 as shown on FIG. 2. The main pump body portion 29 includes a dip tube 34 that extends into the liquid container 12, as shown in FIG. 2. A tailored valve seat 36 is positioned at one end of the dip tube 34 at the transition to the liquid chamber 20. The liquid inlet valve 22 is seated on the tailored valve seat 36 and biased in the closed position. The liquid inlet valve 22 selectively controls the liquid inlet to the liquid chamber 20 and is responsive to a reduction in the pressure in the liquid chamber. The liquid and air bore 32 and the piston dome 30 define the air chamber 16. An air path 38 is defined by the liquid and air bore 32 and provides an air flow path between the air chamber and the mixing zone 19. The mixing zone 19 in the embodiment shown in FIGS. 1 to 16 is a mixing tube 18.

In the embodiment shown herein the liquid container is an upright liquid container 12. The liquid and air bore 32 includes an air inlet valve 26 which is a one way valve that allows air to enter into the liquid container 12. When the liquid and air bore 32 is press fit into the main pump body portion 29, the air inlet valve 26 is deflected to bias it closed. The air inlet valve 26 flexes open when the pressure in the bottle reaches a predetermined pressure such that the liquid container will not collapse. A mating cup 40 is formed in the main pump body portion 29 and a seal off feature 42 formed in the air inlet valve 26 is sealingly seated in the mating cup until the pressure in the liquid container 12 is over a predetermined pressure.

Figure 6:
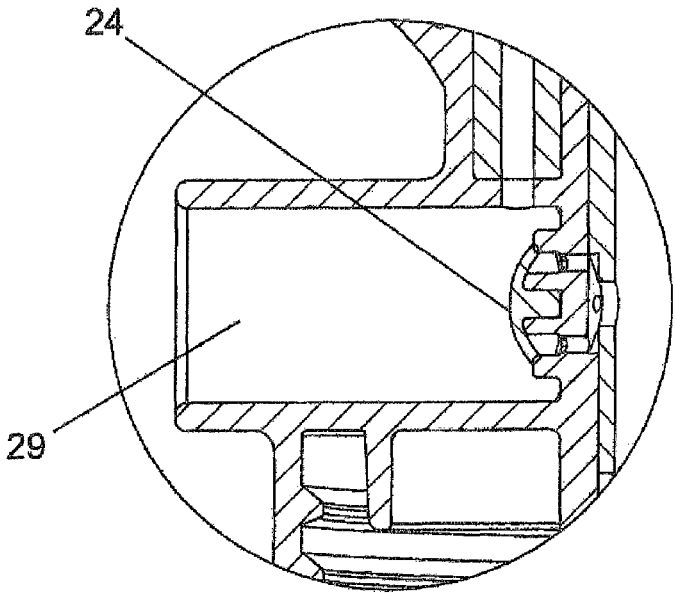
FIG. 6 is an enlarged sectional view of a portion of the pump body including a main pump body portion and a liquid and air bore showing the liquid outlet valve in the closed position.
Figure 7:
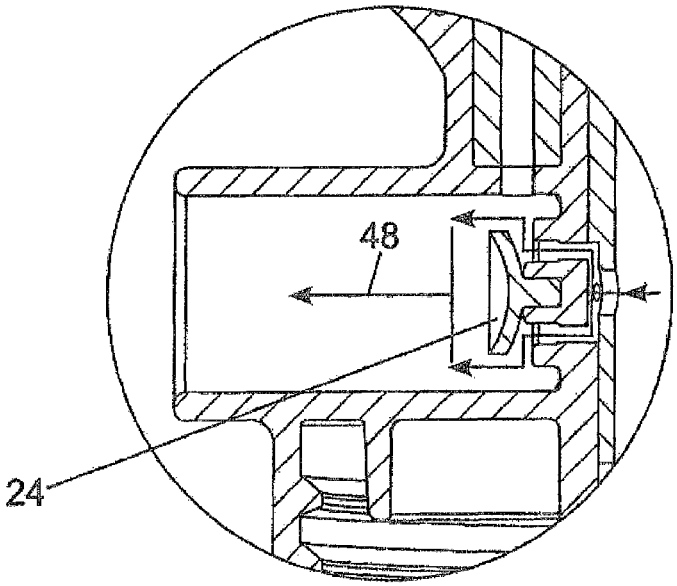
FIG. 7 is an enlarged sectional view of a portion of the pump body including a main pump body portion and a liquid and air bore similar to that shown in FIG. 6 but showing the liquid outlet valve in the open position.

In one embodiment, the main pump body portion 29 has an exit nozzle 44 formed therein as best seen in FIGS. 6 and 7. The liquid outlet valve 24 is press fit into a portion of main pump body portion 29. The liquid outlet valve 24 is positioned at the liquid outlet 46 of the liquid chamber 20. The liquid outlet valve 24 acts similar to an umbrella valve such that as it moves responsive to pressure in the liquid chamber 20 from the rest position as shown in FIG. 6 to the open position as shown in FIG. 7. The liquid outlet valve selectively controls the liquid flowing from the liquid chamber 20 into the mixing tube 18. The arrows 48 shows the flow path of the liquid when the liquid outlet valve 24 is in the open position.

Figure 8:
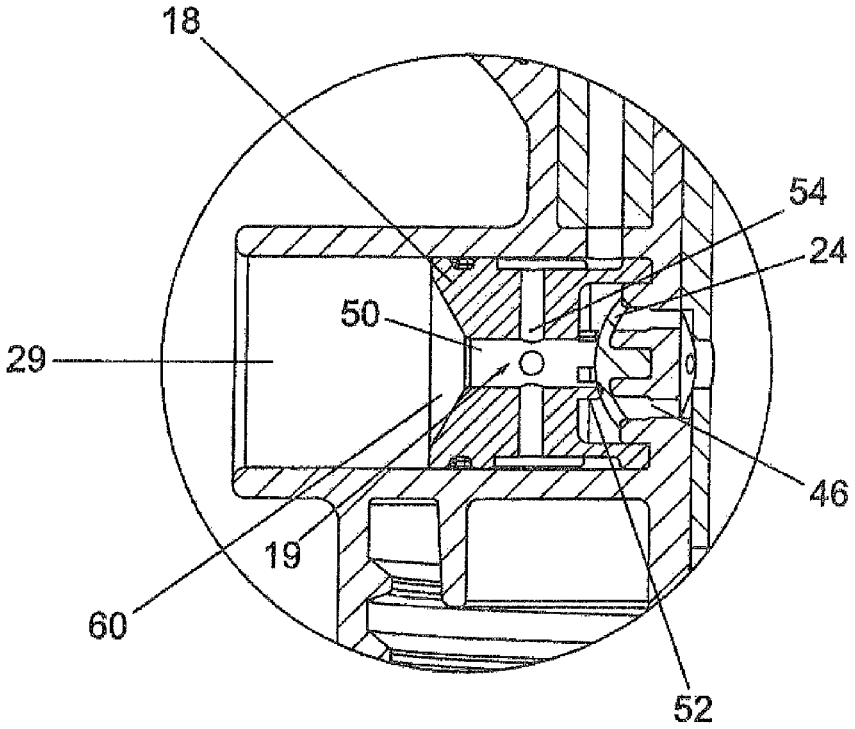
FIG. 8 is an enlarged sectional view of a portion of the pump body including a main pump body portion and a liquid and air bore similar to that shown in FIG. 6 but also including the mixing tube.
Figure 9:
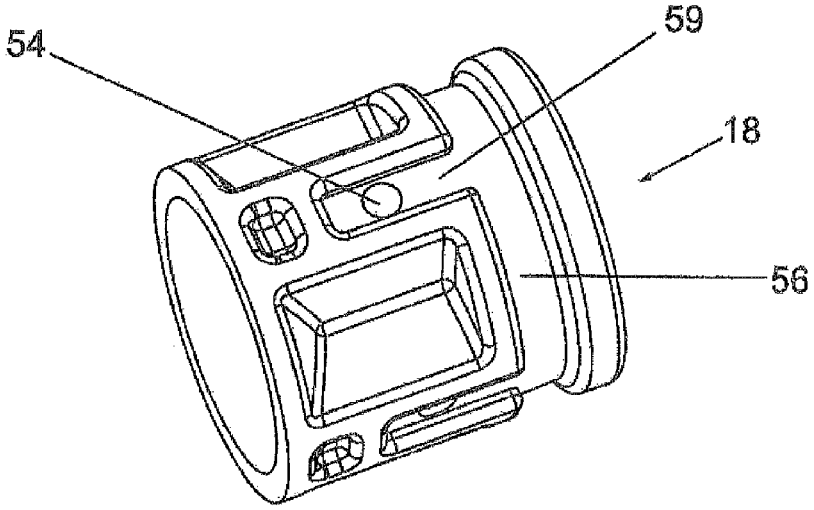
FIG. 9 is an enlarged perspective view of the mixing tube.
Figure 10:
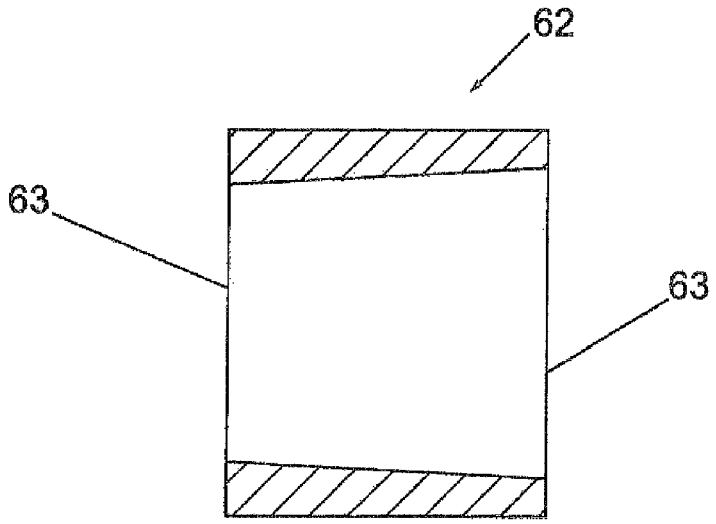
FIG. 10 is an enlarged sectional view of the foam tube.
Figure 11:
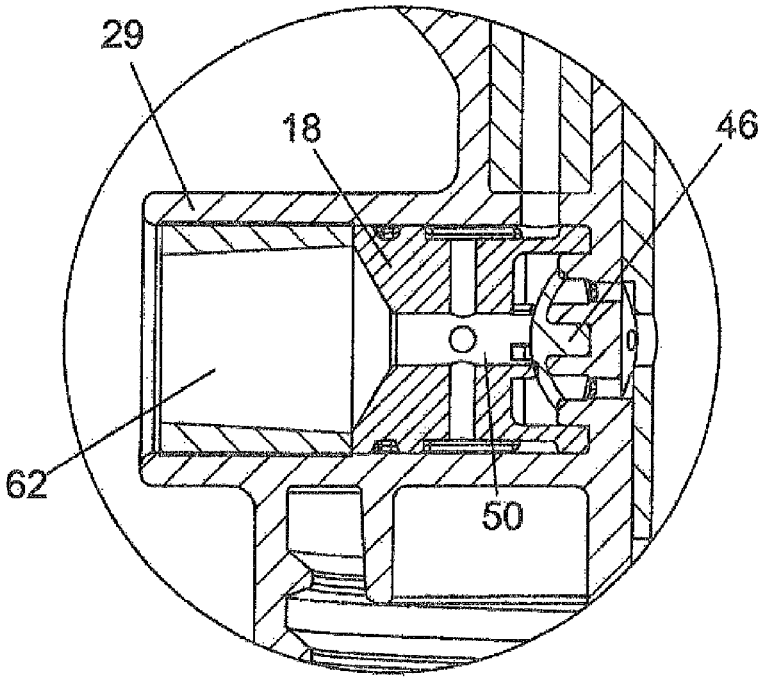
FIG. 11 is an enlarged sectional view of a portion of the pump body including a main pump body portion and a liquid and air bore similar to that shown in FIG. 8 but also including the foam tube.

An embodiment of the mixing tube 18 is shown in FIGS. 8 and 9. The mixing tube 18 is press fit into the exit nozzle 44. The mixing tube 18 has a central elongate mixing channel 50. The mixing tube 18 acts as a stop for the liquid outlet valve 24. The liquid outlet 46 is in flow communication with an upstream end of the elongate mixing channel 50 via an inner annular liquid channel 52. The elongate mixing channel is relatively long and narrow forming a channel from the upstream end to the downstream end. Air is ported into the central elongate mixing channel 50 through at least one air port 54 and in the embodiment shown herein through a plurality of air ports 54. In this embodiment there are four air ports 54 equally spaced around the central elongate mixing channel 50. The mixing tube has an annular gap 56 which in situ creates an outer annular air channel 58. Air channels 59 connect the annular air channel 58 and the air ports 54. Thus air flows from the air chamber 16 through the air path 38 in the liquid and air bore 32 into the outer annular air channel 58 into the air channel 59 through the air ports 54 and into the central elongate mixing channel 50. At the downstream end of the central elongate mixing channel there is an exit zone. The exit zone expands such that it has a cross sectional area that is larger than the cross sectional area of the elongate mixing channel. By way of example the exit zone is a chamfer 60 oriented such that it expands in the downstream direction. The central elongate mixing channel 50 and chamfer 60 together form an elongate venturi tube.

In the embodiment shown herein there are four airports. However, it will be appreciated by those skilled in the art that the number of air ports may vary. In the embodiment shown herein air ports 54 are spaced around the central elongate mixing channel. Accordingly in use air is injected from four sides into the stream of liquid passing through the elongate mixing channel.

A foam tube 62 with at least one porous member 63 is positioned in the exit nozzle 44 such that the porous member is downstream of the elongate mixing channel 50. A foam tube 62 is press fit downstream of the mixing tube 18. The foam tube is tapered such that the downstream end has a smaller diameter than the upstream end. Alternatively the foam tube 62 could have a parallel bore. The foam tube may have a porous member 63 attached to one or both ends thereof. The porous member may be mesh, gauze, foam, sponge or other suitable porous material and may be the same gauge or a larger gauge upstream of a smaller gauge. Accordingly the user may tailor their choice of porous member to the type and characteristics of the liquid.

The piston dome 30 operably attached to the main pump body whereby it is retained between the main pump body portion 29 and the liquid and air bore 32. The piston dome has a liquid piston portion 35 which sealingly fits inside the liquid chamber 20 and slides up and down in the liquid chamber to change the volume of the liquid chamber 20 responsive to the movement of the piston dome 30. The piston dome 30 is resiliently deformable such that once it has been depressed the profile and material of the piston dome will return to its at rest position without the need for a spring. The liquid and air bore 32 and piston dome 30 together define the air chamber 16 whereby when the piston dome 30 is pushed inwardly the volume of the air chamber 16 is reduced.

The foam dispenser 10 also includes a transit cap 66 which is press fit onto the exterior of the exit nozzle 44 as best seen in FIGS. 1 to 3. The transit cap 66 includes a pull tab 68 to aid in the removal when ready to be used.

Figure 12:
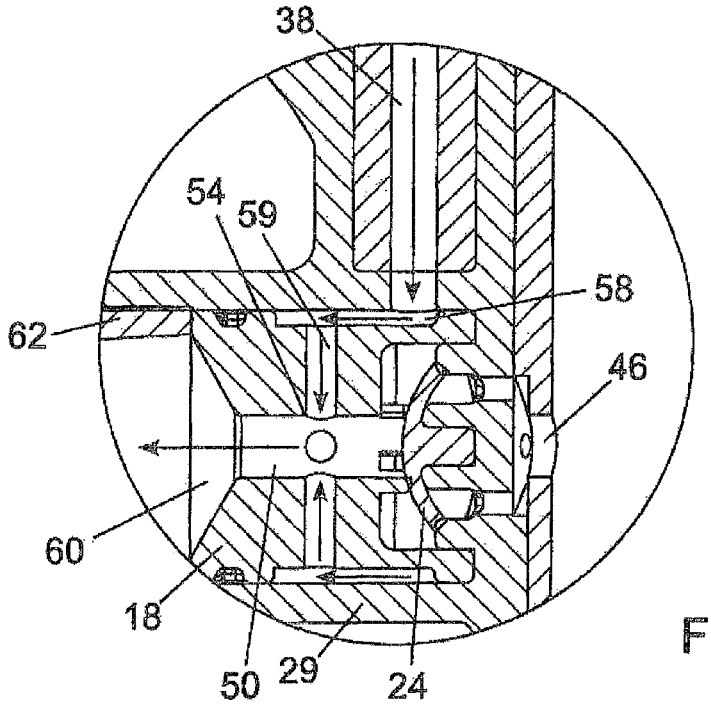
FIG. 12 is an enlarged sectional view of a portion of the pump body including a main pump body portion and a liquid and air bore similar to that shown in FIG. 11 and showing the air flow during the activation stroke.
Figure 13:
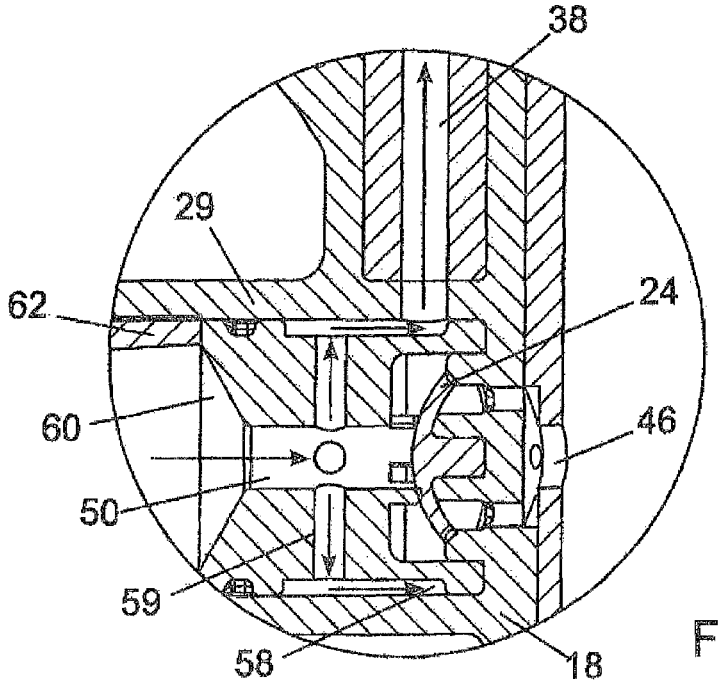
FIG. 13 is an enlarged sectional view of a portion of the pump body including a main pump body portion and a liquid and air bore similar to that shown in FIG. 11 and showing the air flow during the return stroke.
Figure 15:
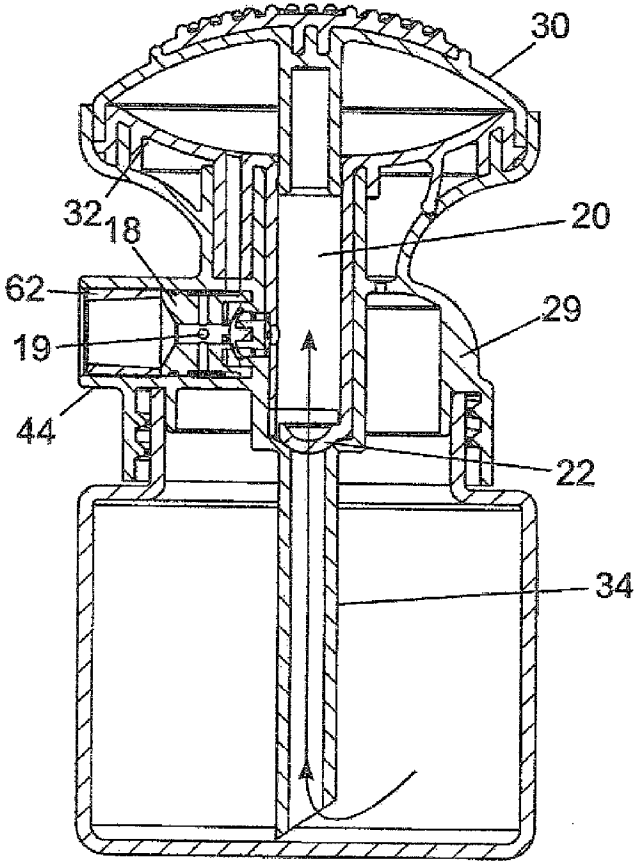
FIG. 15 is a sectional view of the foam dispenser similar to that shown in FIG. 2 and showing the liquid flow during the return stroke.
Figure 14:
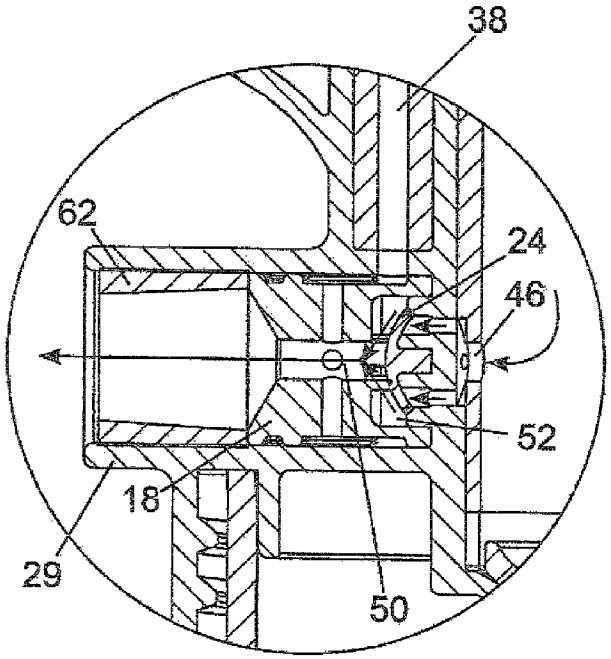
FIG. 14 is an enlarged sectional view of a portion of the pump body including a main pump body portion and a liquid and air bore similar to that shown in FIG. 11 and showing the liquid flow during the activation stroke.
Figure 16:
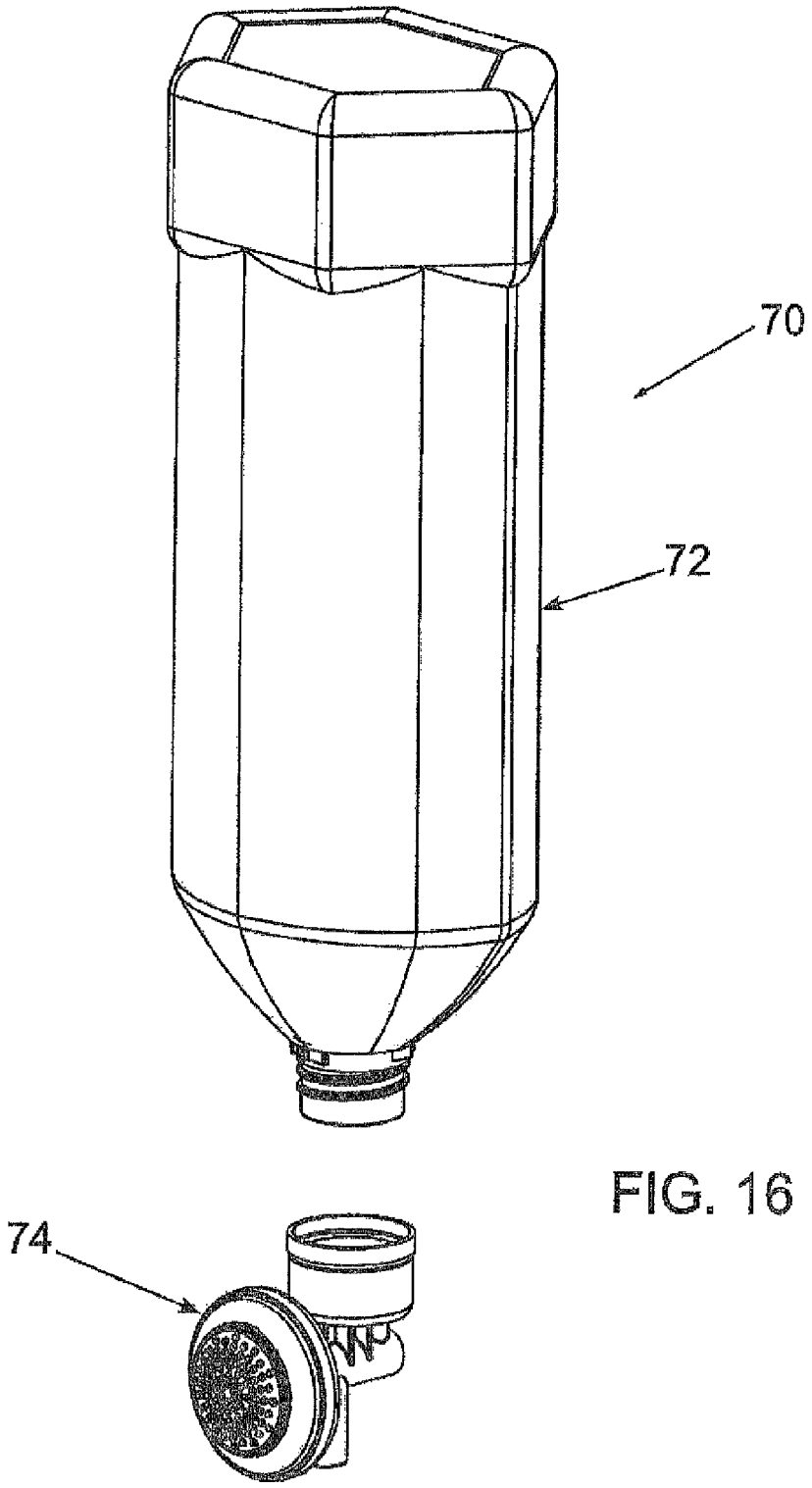
FIG. 16 is a perspective view of an alternate embodiment of the foam dispenser with an inverted cartridge.
Figure 17:
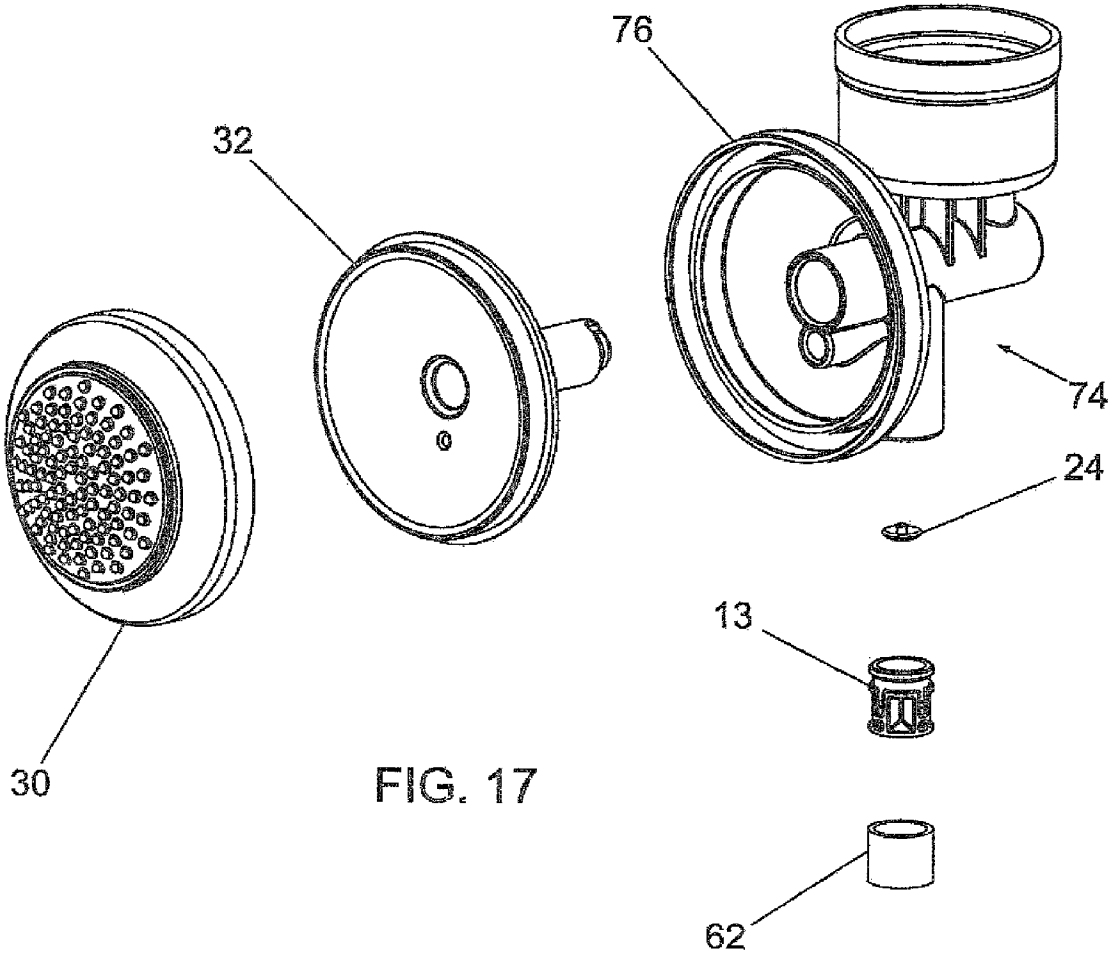
FIG. 17 is a blown apart perspective view of the foaming assembly of the dispenser of FIG. 16.
Figure 18:
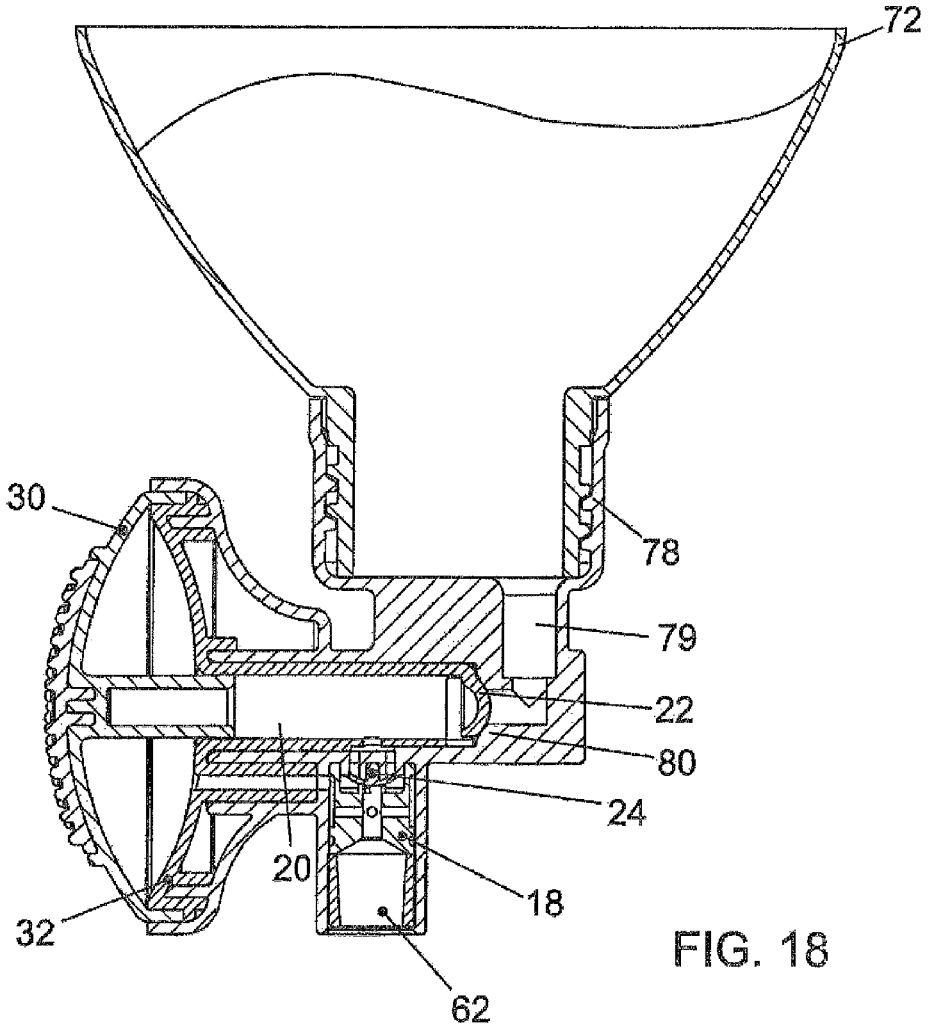
FIG. 18 is an enlarged sectional view of the foaming assembly and a portion of the inverted cartridge of the dispenser of FIG. 16.

In use the piston dome 30 is compressed and air from the air chamber 16 is pushed through the air path 38 into the outer annular air channel 58 through air ports 54 and into the central elongate mixing channel 50 in mixing tube 18 as shown in FIG. 12. Mixing tube 18 is constructed so that the air from the air chamber 16 is under pressure when it enters the central elongate mixing channel 50 through the air ports 54. When the piston dome 30 is released the resiliently deformable dome returns to its original shape and the air chamber is recharged. When the piston dome 30 returns to its original shape, a sucking action draws air through the mixing tube and back into the air chamber 16, as shown in FIG. 13. If there is any liquid or foam still in the mixing tube 18 it too will be sucked back into the foaming assembly 14. In regard to the liquid flow, when the piston dome 30 is compressed liquid pressure in the liquid chamber 20 builds up such that liquid outlet valve 24 opens and liquid flows into the central elongate mixing channel 50 of mixing tube 18 as shown in FIG. 14. When the piston dome 30 returns to its original shape in the return stroke the liquid chamber is recharged because a vacuum is created in the liquid chamber 20 and the liquid inlet valve 22 is opened and liquid is sucked into the liquid chamber 20 as shown in FIG. 15.

As can be seen in FIG. 3 foam dispenser 10 is constructed from eight pieces namely the piston dome 30, the liquid and air bore 32, the main pump body portion 29, the liquid container 12, the liquid outlet valve 24, the mixing tube 18, the foam tube 62 and the transit cap 66. The main pump body portion 29 and the liquid and air bore 32 have some of the other features integrally formed therein. By way of example the air inlet valve 26, the liquid inlet valve 22 and the air path 38 are integrally formed in the liquid and air bore 32. Similarly the dip tube 34 is integrally formed in the main pump body portion 29. The piston dome 30 and the liquid and air bore 32 cooperate to form the air chamber 16 and the liquid chamber 20 and they are supported by the main pump body portion 29. The respective volume of the air chamber 16 and liquid chamber 20 is dependent on the position of the piston dome 30. During the activation stroke of the piston dome 30, the piston dome 30 moves from an at rest position to a depressed position whereby responsively the volume of the air chamber 16 and the volume of the liquid chamber 20 are both reduced. In the return stroke the piston dome 30 moves from the depressed position back to the at rest position wherein the volume of the air chamber 16 and the liquid chamber 20 are both returned to their maximum volume.

An alternate foam dispenser 70 is shown in FIGS. 16 to 20 wherein the liquid container is an inverted liquid container 72. The foaming assembly 74 is similar to the foaming assembly 14 described above and only those portions of the foaming assembly 74 that are different from foaming assembly 14 will be described in detail. Main pump body portion 76 has a connecting portion 78 which is connectable to the inverted liquid container 72. In the embodiment shown herein connecting portion 78 is connected using a threaded connection, however any leak free connection may be used.

The main pump body portion 76 includes a liquid channel 79 which is in flow communication with the liquid chamber 20. The upstream end of the liquid channel 79 includes a valve seat 80. The liquid inlet valve 22 is seated on the valve seat 80 and biased in the closed position.

Figure 19:
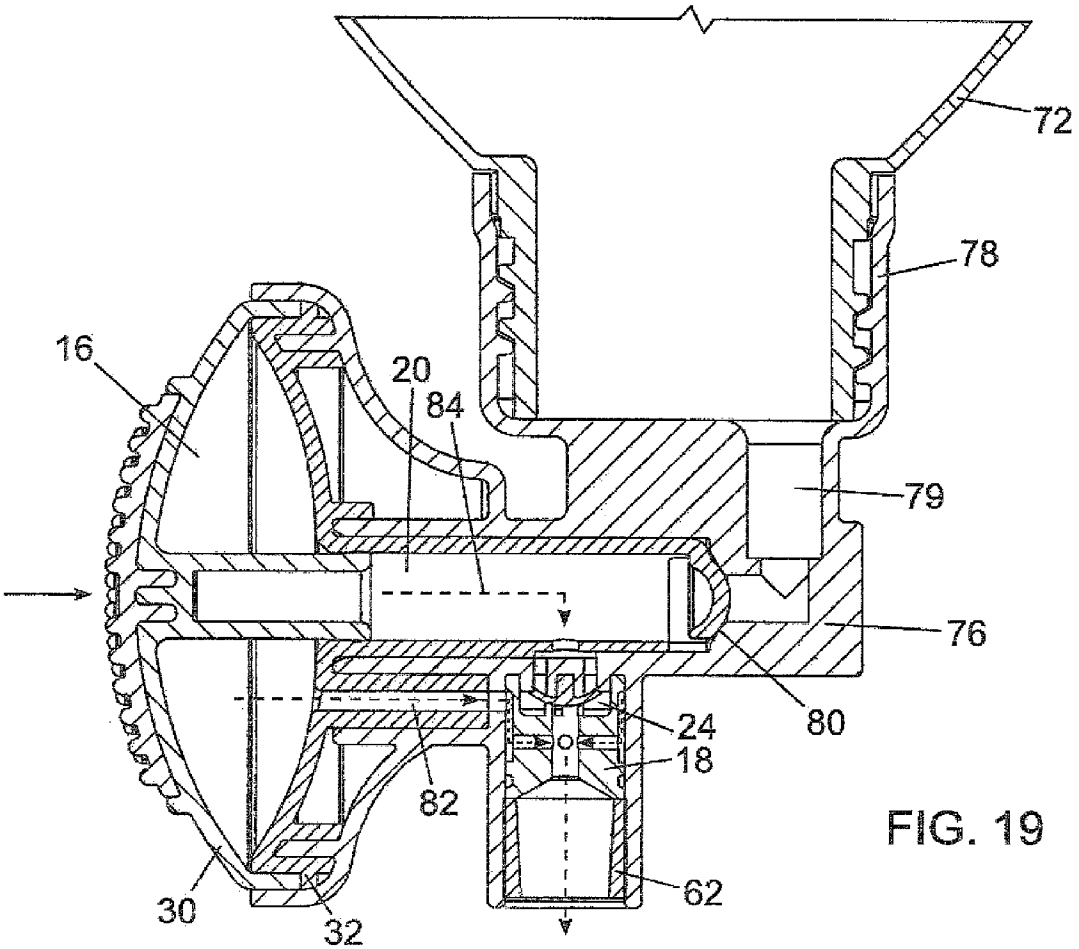
FIG. 19 is an enlarged sectional view of the foaming assembly and a portion of the inverted cartridge similar to that shown in FIG. 18 and showing the air and liquid flow during the activation stroke.
Figure 20:
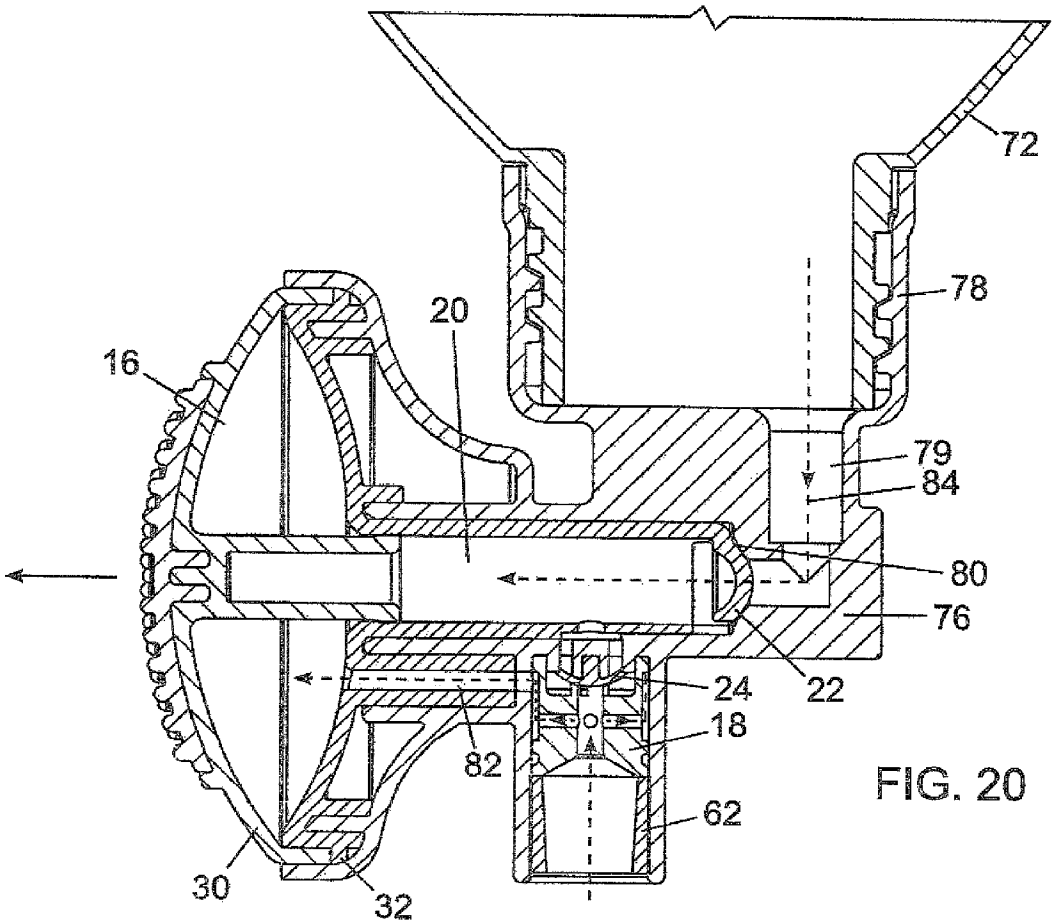
FIG. 20 is an enlarged sectional view of the foaming assembly and a portion of the inverted cartridge similar to that shown in FIG. 18 and showing the air and liquid flow during the return stroke.
Figure 21:
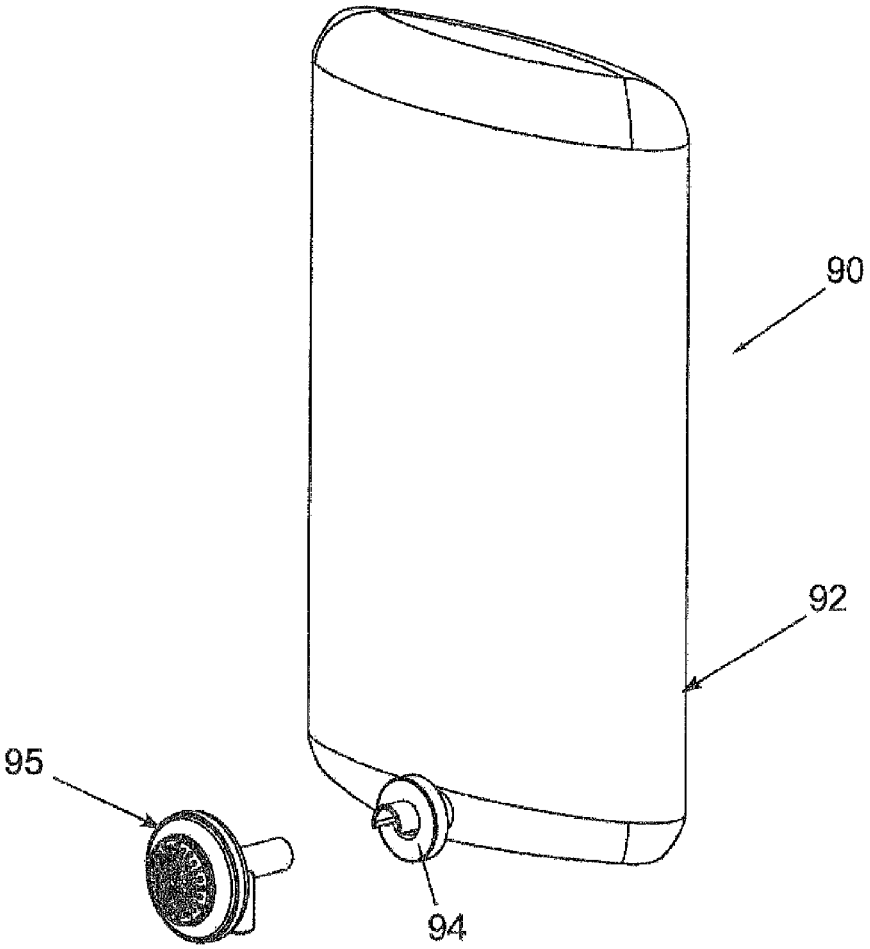
FIG. 21 is a perspective view of another alternate embodiment of the foam dispenser with a pouch.
Figure 22:
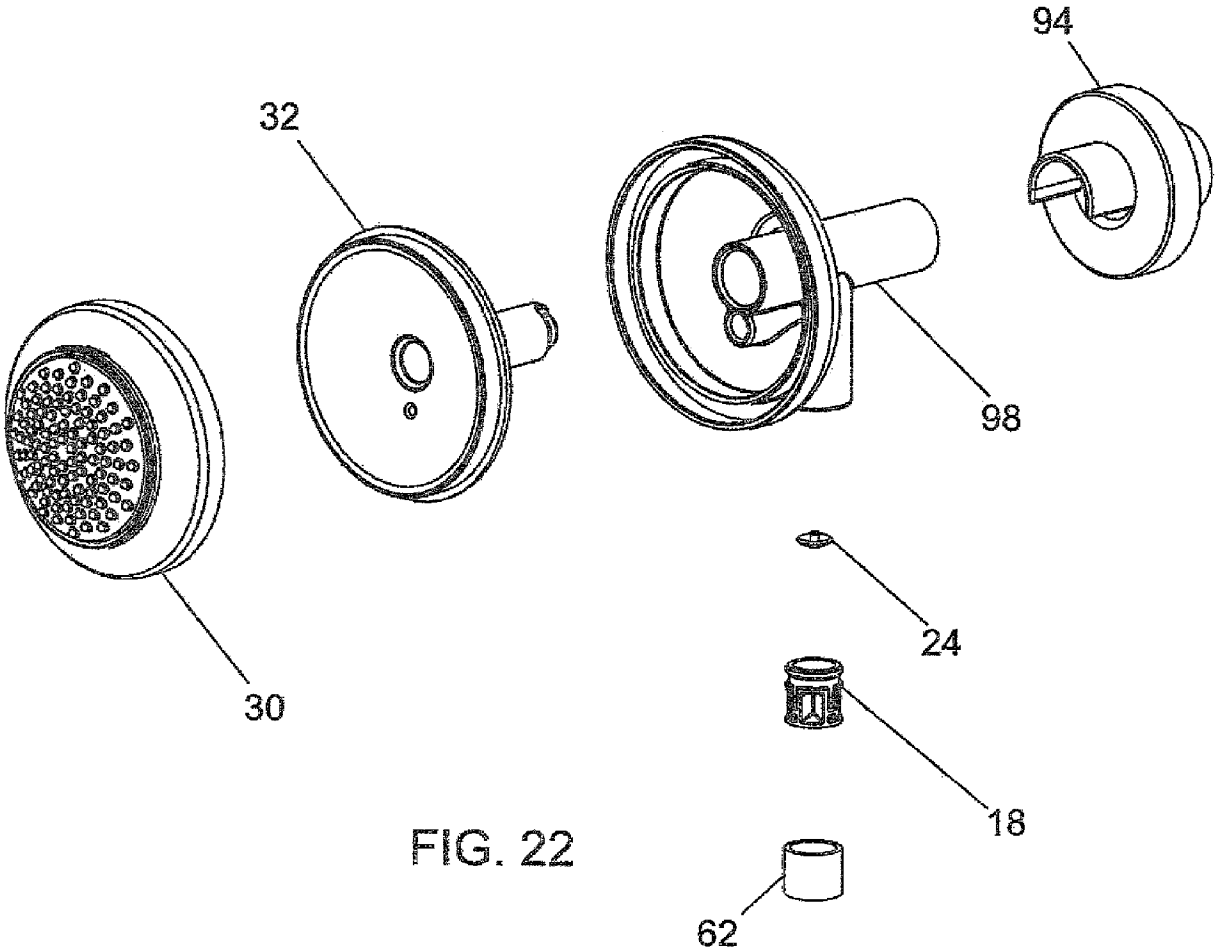
FIG. 22 is a blown apart perspective view of the foaming assembly of the dispenser of FIG. 21.
Figure 23:
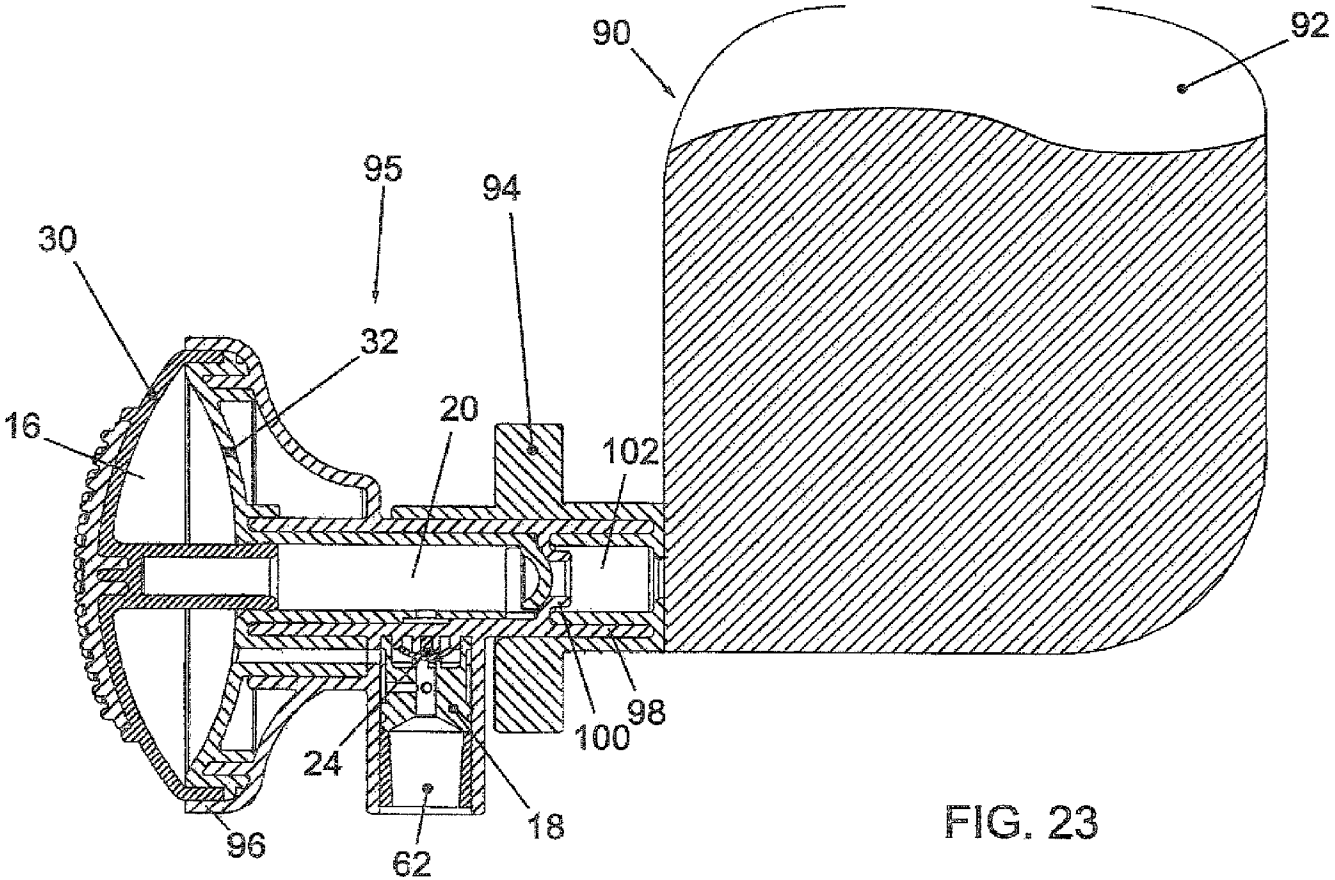
FIG. 23 is an enlarged sectional view of the foaming assembly and a portion of the inverted cartridge of the dispenser for FIG. 21.

The flow of air and liquid through the foaming assembly 74 when the piston dome 30 is compressed is shown in FIG. 19 and after it has been released is shown in FIG. 20. The air flow is shown with arrows 82 and the liquid flow with arrows 84.

Inverted liquid container 72 is a collapsible container. Thus in this embodiment the foaming assembly 74 need not contain an air inlet and air inlet valve that is in flow communication with the liquid container.

Another alternate foam dispenser 90 is shown in FIGS. 21 to 25 wherein the liquid container is an inverted collapsible liquid pouch 92 with a pouch connector 94 attached thereto. Foam dispenser 90 is similar to both foam dispenser 10 and foam dispenser 70 described above.

Foam dispenser 90 includes foaming assembly 95 with a main pump body portion 96 which has a connector portion 98 which connects to pouch connector 94. Connector portion 98 includes a valve seat 100 and the liquid inlet valve 22 is seated on the valve seat 100 and biased in the closed position. Pouch connector 94 has a liquid channel 102 which when the pouch connector 94 is connected to the connector portion 98 of the main pump body portion 96 is in flow communication with liquid chamber 20.

Figure 24:
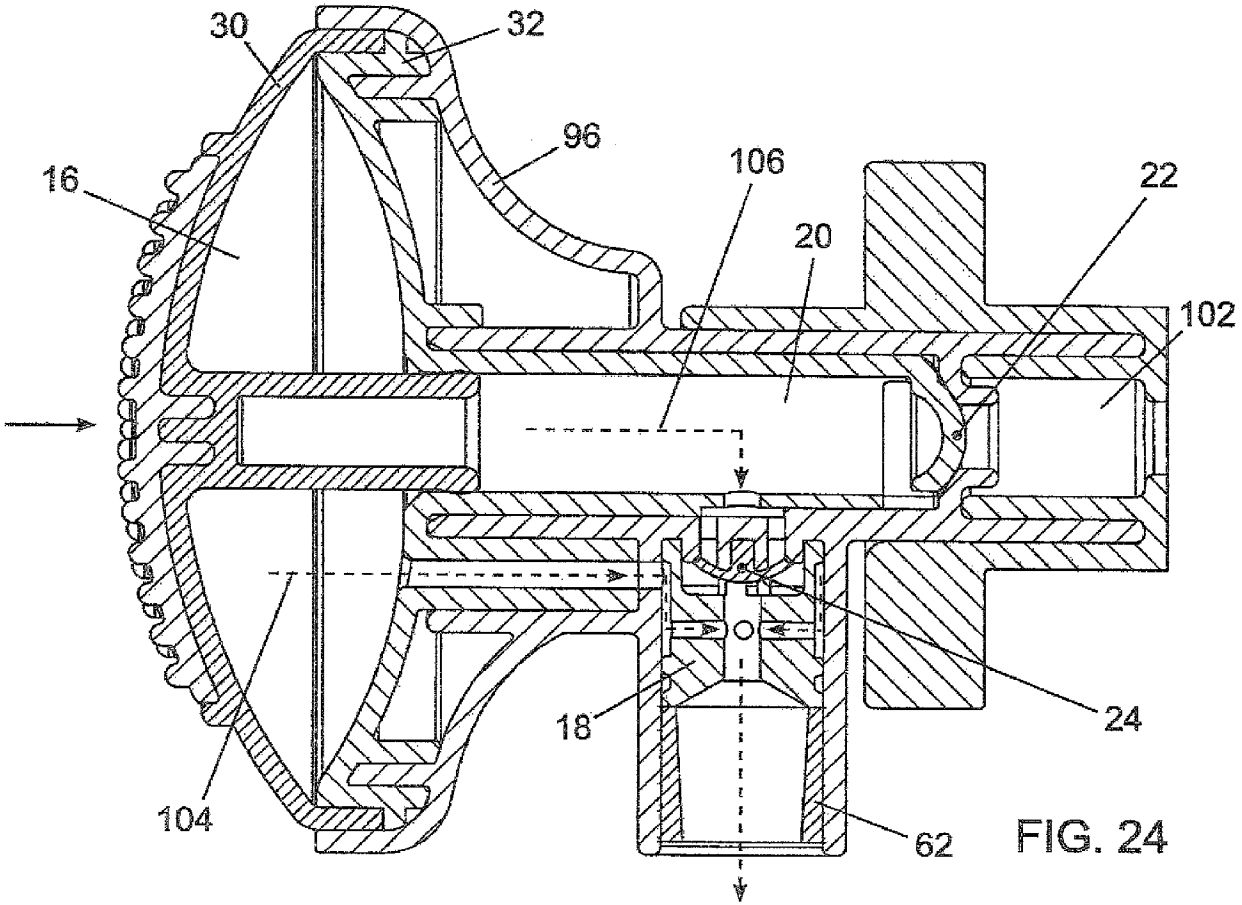
FIG. 24 is an enlarged sectional view of the foaming assembly similar to that shown in FIG. 23 and showing the air and liquid flow during the activation stroke.
Figure 25:
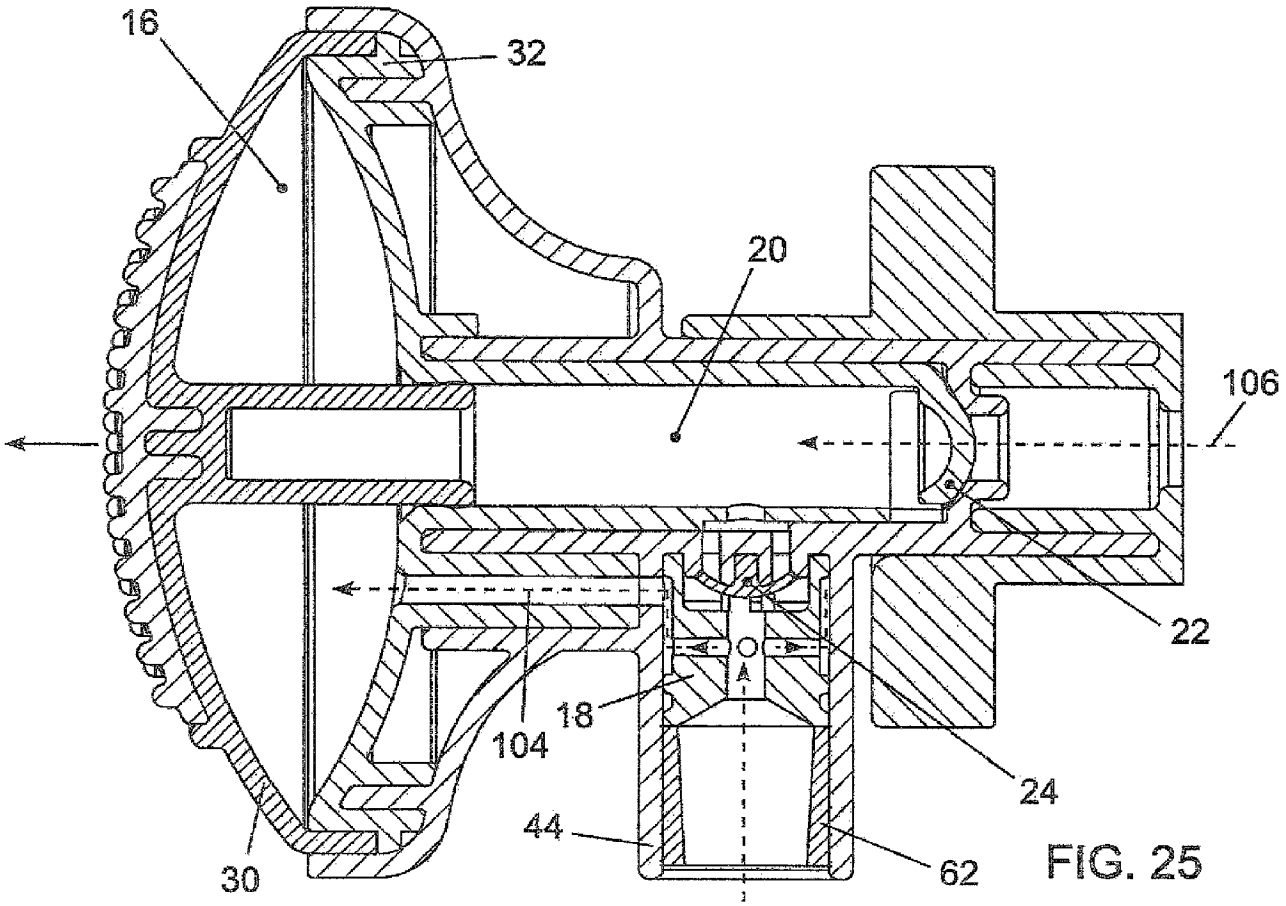
FIG. 25 is an enlarged sectional view of the foaming assembly and a portion of the inverted cartridge similar to that shown in FIG. 23 and showing the air and liquid flow during the return stroke.

The flow of air and liquid through the foaming assembly 90 when the piston dome 30 is compressed is shown in FIG. 24 and after it has been released is shown in FIG. 25. The air flow is shown with arrows 104 and the liquid flow with arrows 106.

Figure 26:
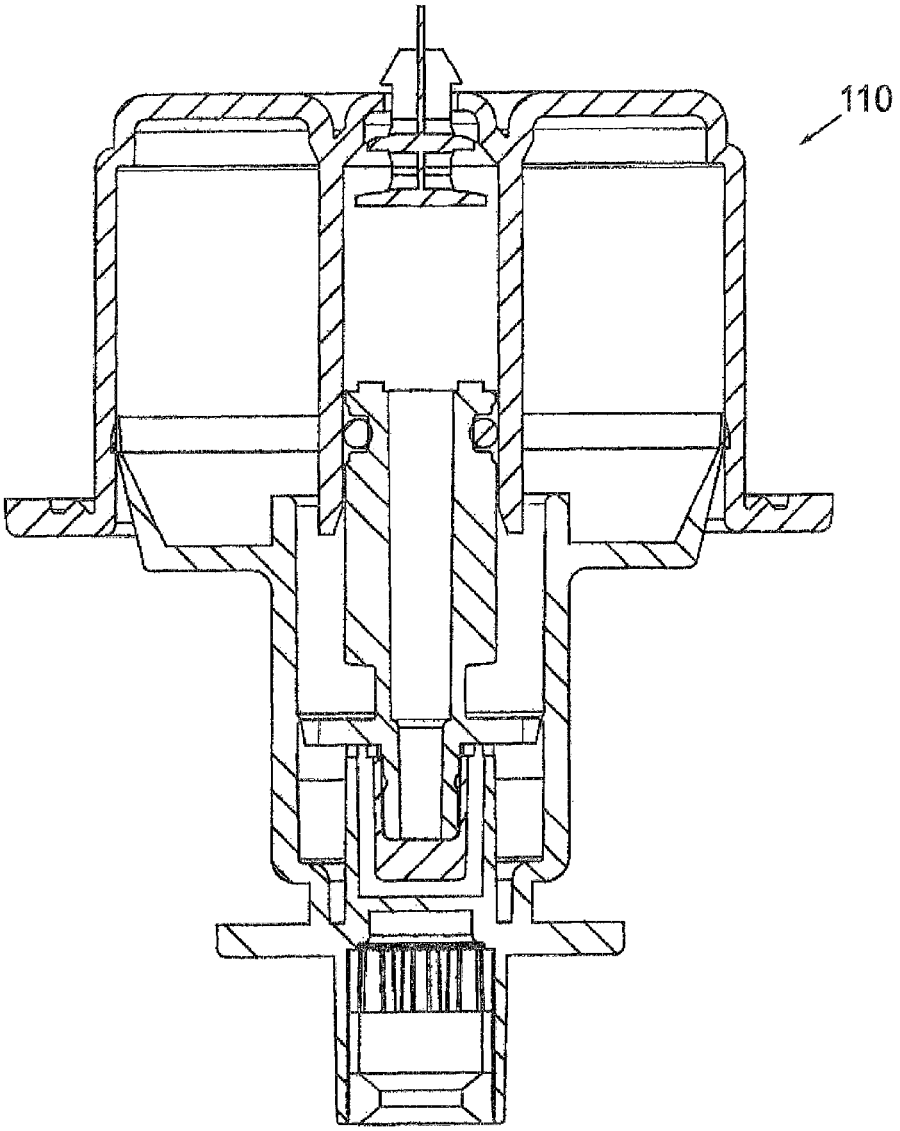
FIG. 26 (PRIOR ART)
FIG. 26 is a sectional view of a prior art foaming assembly.
Figure 28:
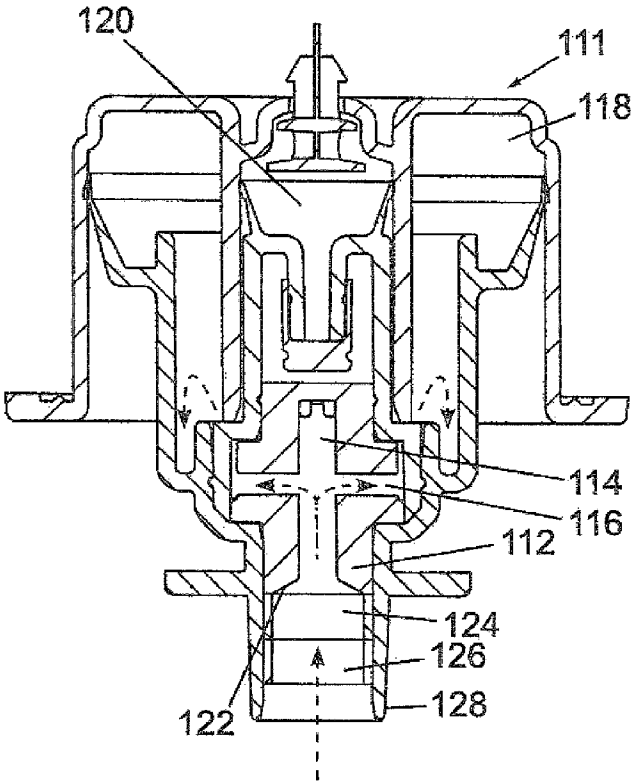
FIG. 28 is a sectional view of the alternate foaming assembly including a mixing tube shown in FIG. 26 but showing the air and liquid flow during the return stroke.
Figure 27:
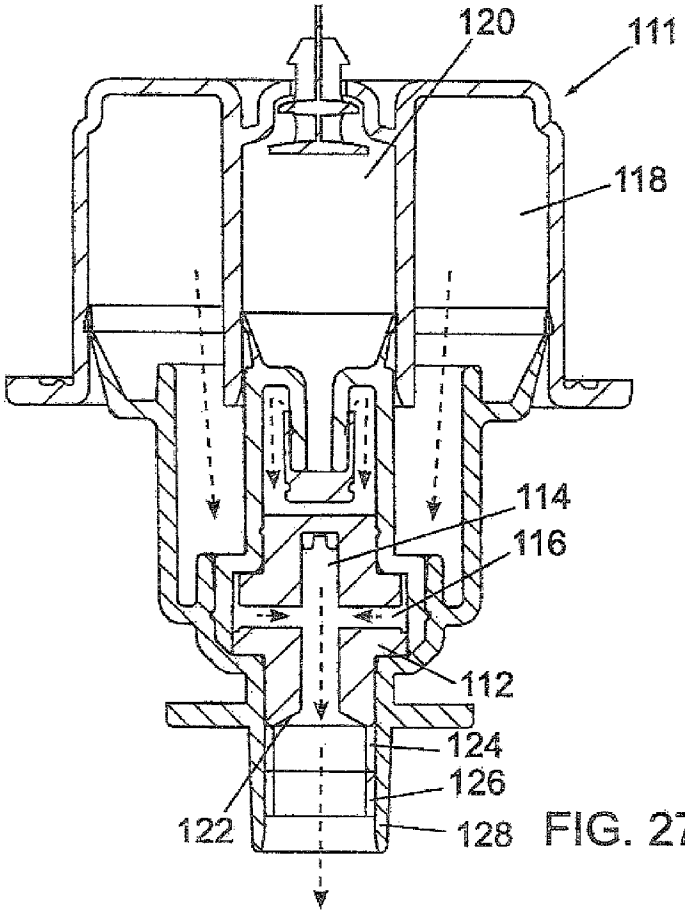
FIG. 27 is a sectional view of an alternate foaming assembly including a mixing tube and showing the air and liquid flow during the activation stroke.
Figure 29:
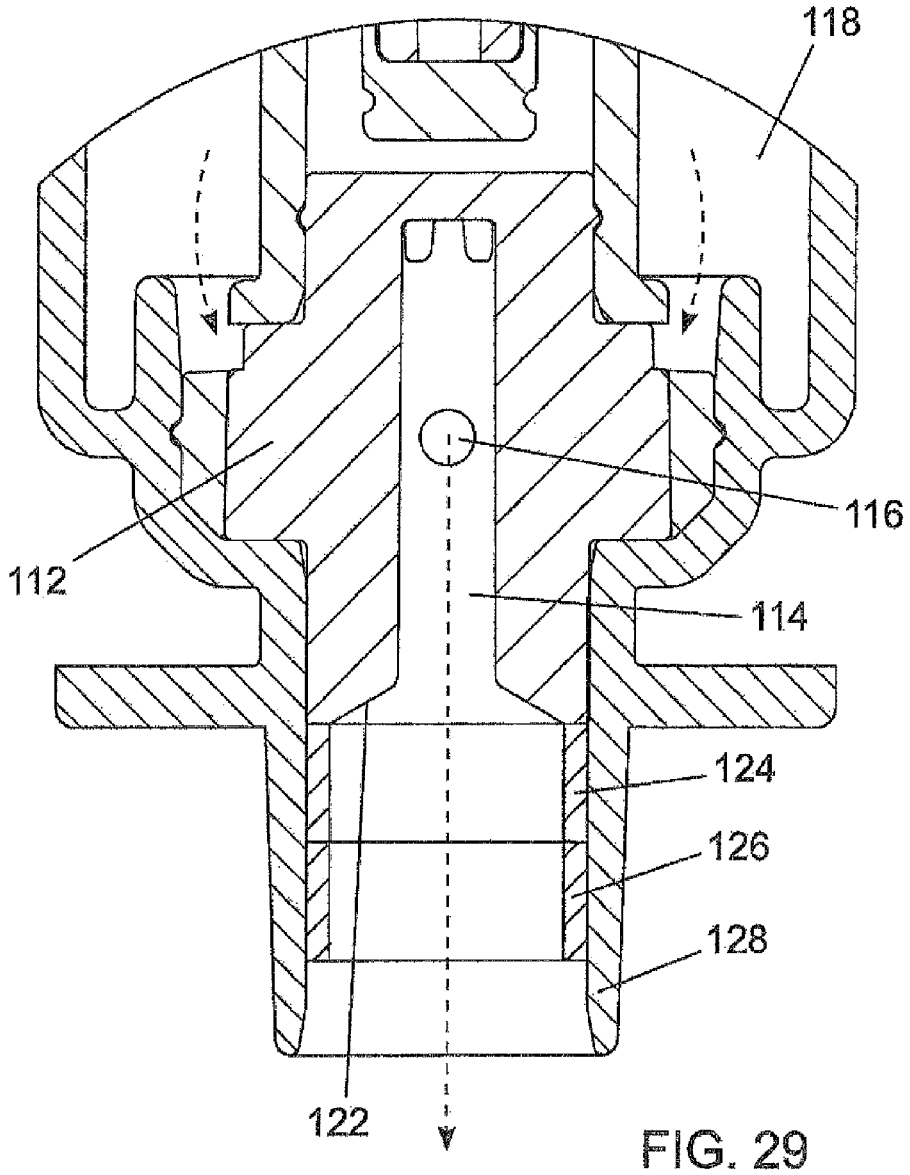
FIG. 29 is a sectional view of a portion of the alternate foaming assembly showing the mixing tube but sectioned 90 degrees from the views shown in FIGS. 26 and 28.

The mixing tube 18 or alternate embodiments of the mixing tube may be used in other foam dispensers. Any foam dispenser that has an air chamber, a liquid chamber and a means for pressurizing the air chamber and liquid chamber may be modified to incorporate the mixing tube shown herein. An example of a prior art foam assembly for a dispenser is shown in FIG. 26 and an embodiment of a mixing tube 112 is shown in FIGS. 27 to 29 and an alternate embodiment of a mixing tube 130 is shown in FIGS. 30 to 33. The prior art foam assembly 110 shown herein is a foam assembly for a dispenser similar to that shown in U.S. Pat. No. 6,082,586. The dispenser includes pump that has an activation stroke wherein the pump moves from an at rest position to a compressed position and a return stroke wherein the pump moves from the compressed position to an at rest position. The volume of the air chamber and liquid chamber are each substantially smaller in the compressed position.

Referring to FIGS. 27 to 29, the mixing chamber shown in U.S. Pat. No. 6,082,586 has been modified to include a mixing tube 112. In addition, since the mixing tube 112 is more efficient than the prior art mixing chamber the volume of the air chamber could be reduced while generally maintaining the quality of the foam. Mixing tube 112 is similar to mixing tube 18 described above with a central elongate mixing channel 114 and air ports 116. In this embodiment there are two air ports 116 equally spaced generally equidistant from each other around the central elongate mixing channel 114. At the downstream end of the central elongate mixing channel 114 there is an exit zone which herein is a chamfer 122. The mixing elongate channel 114 and the chamfer 122 together form an elongate venturi tube.

The foam dispenser includes a foaming assembly 111 with an air chamber 118 and a liquid chamber 120. The air chamber 118 is in flow communication with the central elongate mixing channel 114 through air ports 116. The liquid chamber 120 is in flow communication with the central elongate mixing channel 114 at the upstream end of the elongate mixing channel. At the downstream end of the central elongate mixing channel 114 there is a chamfer 122. An upstream or first 124 and a downstream or second 126 foam tube are in the exit nozzle 128 downstream of the mixing tube 112. Each foam tube 124, 126 has a porous member attached thereto. Alternatively there may be one foam tube with a porous member attached to each end thereof. Accordingly the second foam tube has 126 a second foam tube porous member attached thereto. Typically the upstream porous member has larger holes than the downstream porous member. The inside diameter of the upstream foam tube 124 is generally the same as the downstream end of the chamfer 122. It has been observed that in the configuration shown in FIGS. 27 to 29 there is a risk that after activation the dispenser might drip. Accordingly an exit valve could be added or the volume of the air well below the air ports could be increased.

Figure 31:
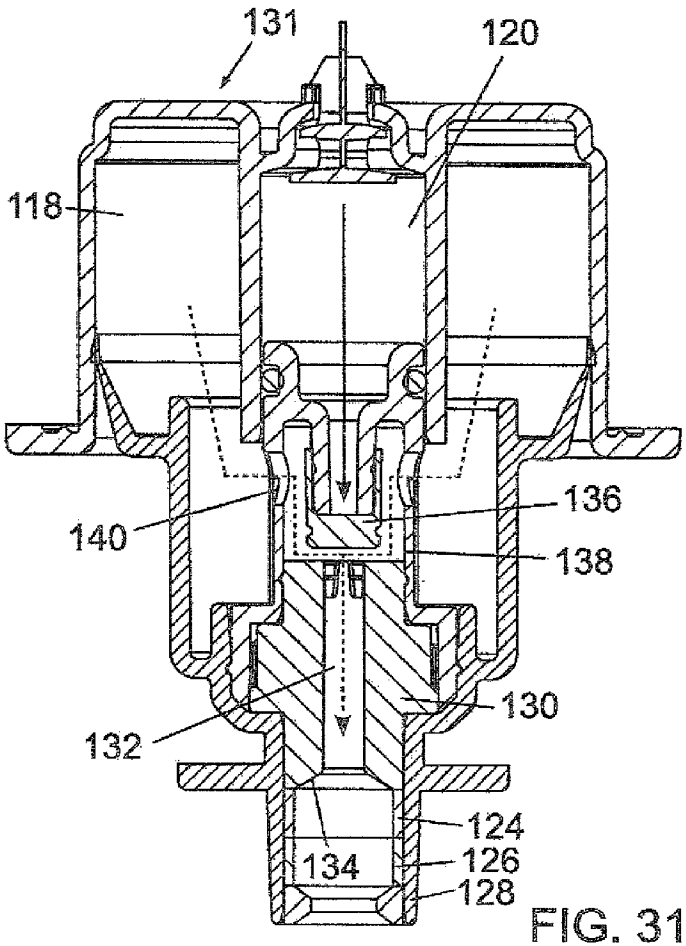
FIG. 31 is a sectional view of the foaming assembly of FIG. 30 during the activation stroke.
Figure 30:
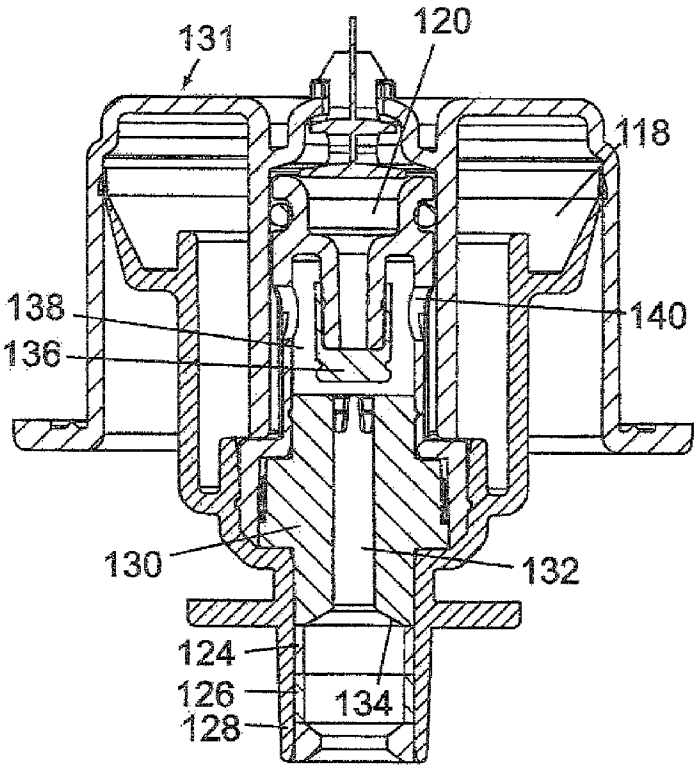
FIG. 30 is a sectional view of an alternate embodiment of the foaming assembly during the return stroke, the foaming assembly being similar to that shown in FIGS. 27 to 30 but showing a different path for air into the mixing chamber.
Figure 33:
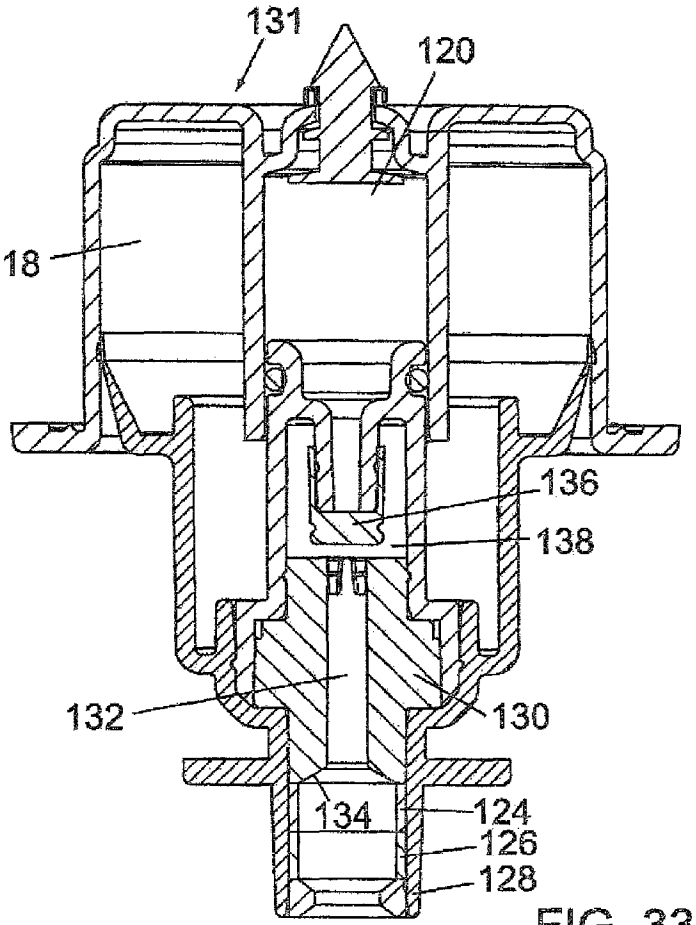
FIG. 33 is a sectional view of the foaming assembly of FIG. 31 but sectioned 90 degrees therefrom.
Figure 32:
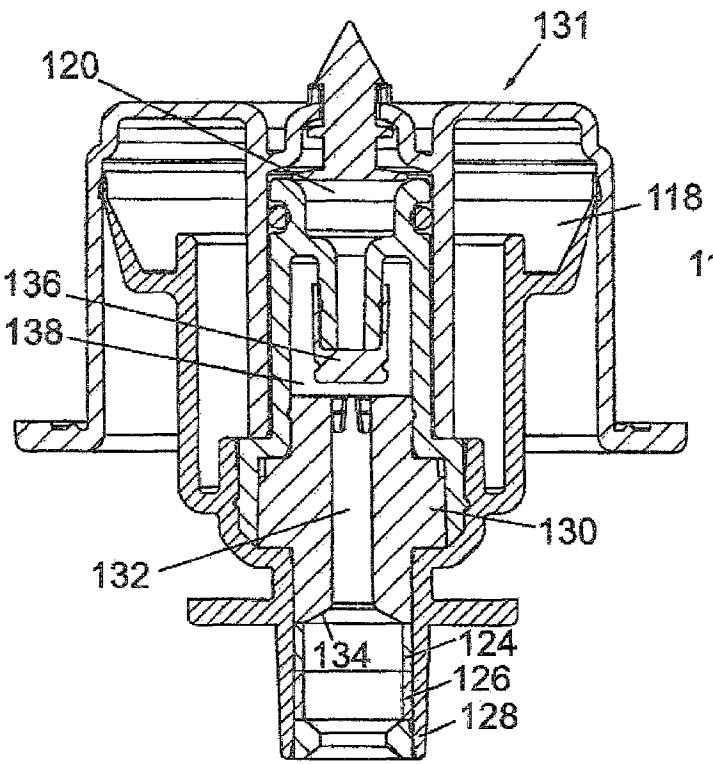
FIG. 32 is a sectional view of the foaming assembly of FIG. 30 but sectioned 90 degrees therefrom.

An alternate embodiment of the foaming assembly 131 and an alternate mixing tube 130 is shown in FIGS. 30 to 33. FIG. 30 shows the return stroke and FIG. 31 shows the activation stroke. Similarly FIG. 32 also shows the return stroke but it is a sectional view 90 degrees the view shown in FIG. 30. therefrom and FIG. 33 is the activation stroke taken 90 degrees from FIG. 31.

Mixing tube 130 is similarly for use in a modified foam dispenser that is similar to the foam dispenser shown in U.S. Pat. No. 6,082,586. Mixing tube 130 is similar to mixing tube 112 described above with a central elongate mixing channel 132 and an exit zone which herein is a chamfer 134. In this embodiment there are no air ports in the mixing tube 130 per se, rather the liquid and the air is mixing together up stream of the mixing tube 130. The elongate mixing channel 132 and the chamfer 134 together form an elongate venturi tube.

The foam dispenser includes a foaming assembly with an air chamber 118 and a liquid chamber 120. Liquid chamber 120 has an exit valve 136 which controls the flow of the liquid into a mixing chamber 138. Air chamber 118 has an outlet port 140 into mixing chamber 138. Mixing chamber 138 is upstream of mixing tube 130. Mixing chamber 138 is in flow communication with the central elongate mixing channel 132 at the upstream end of the mixing tube 130. At the downstream end of the central elongate mixing channel 114 there is a chamfer 122. An upstream 124 and a downstream 126 foam tube are in the exit nozzle 128 downstream of the mixing tube 130. The inside diameter of the upstream foam tube 124 is generally the same as the downstream end of the chamfer 134.

Figure 34:
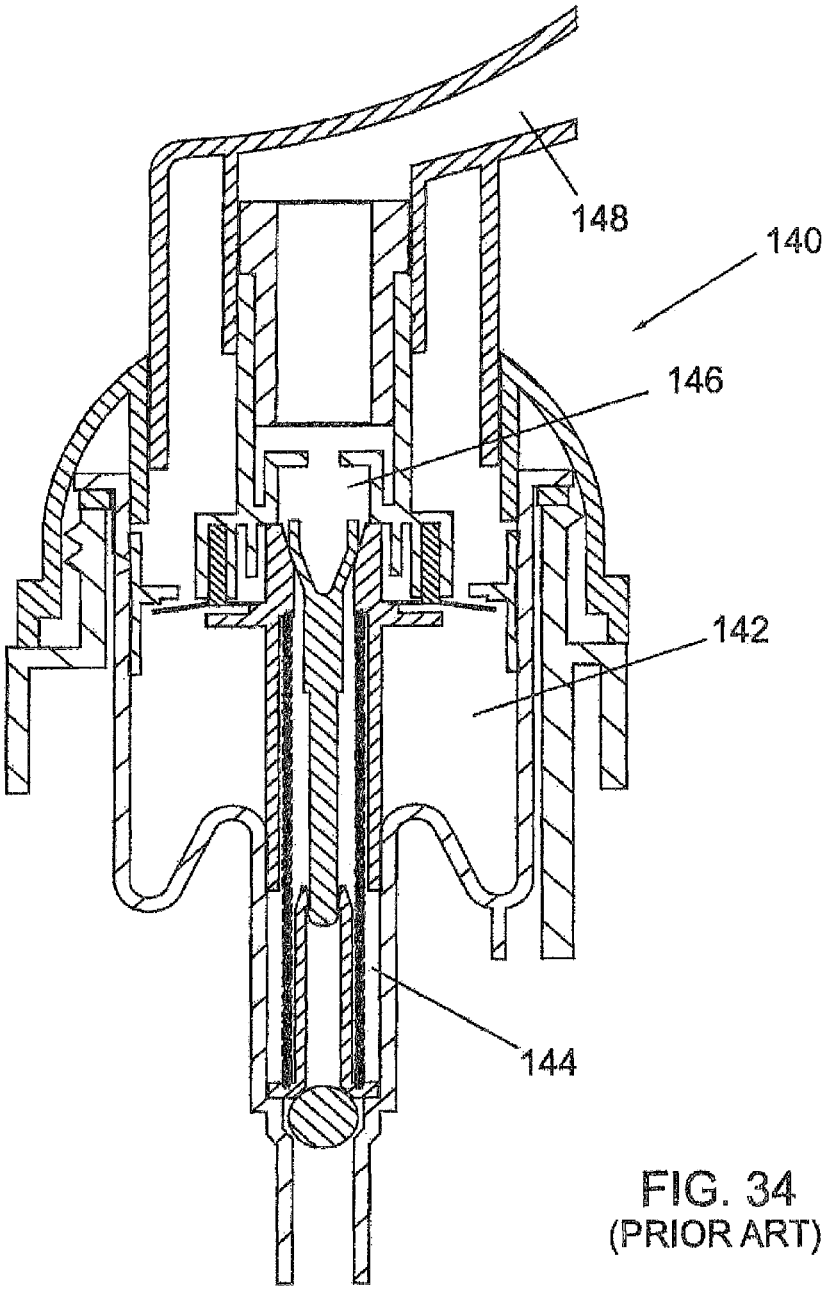
FIG. 34 (PRIOR ART)
FIG. 34 is a sectional view of an alternate prior art foaming assembly.

Referring to FIG. 34 the foaming assembly of an upright foam dispenser is shown generally at 140. The foaming assembly 140 includes an air chamber 142, a liquid chamber 144, a mixing chamber 146 and an exit nozzle 148. This dispenser is described in detail in U.S. Pat. No. 5,443,569 issued to Uehira et al. on Aug. 22, 1995. This dispenser includes a pump that has an activation stroke wherein the pump moves from an at rest position to a compressed position and a return stroke wherein the pump moves from the compressed position to an at rest position. The volume of the air chamber and liquid chamber are each substantially smaller in the compressed position.

Figure 36:
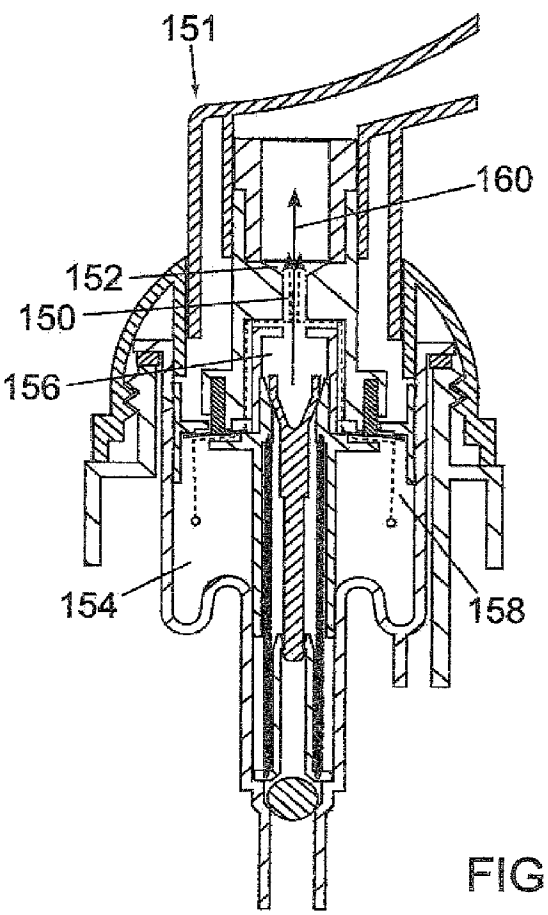
FIG. 36 is a sectional view similar to that shown in FIG. 35 but showing the air flow path and liquid flow path on the activation stroke.
Figure 35:
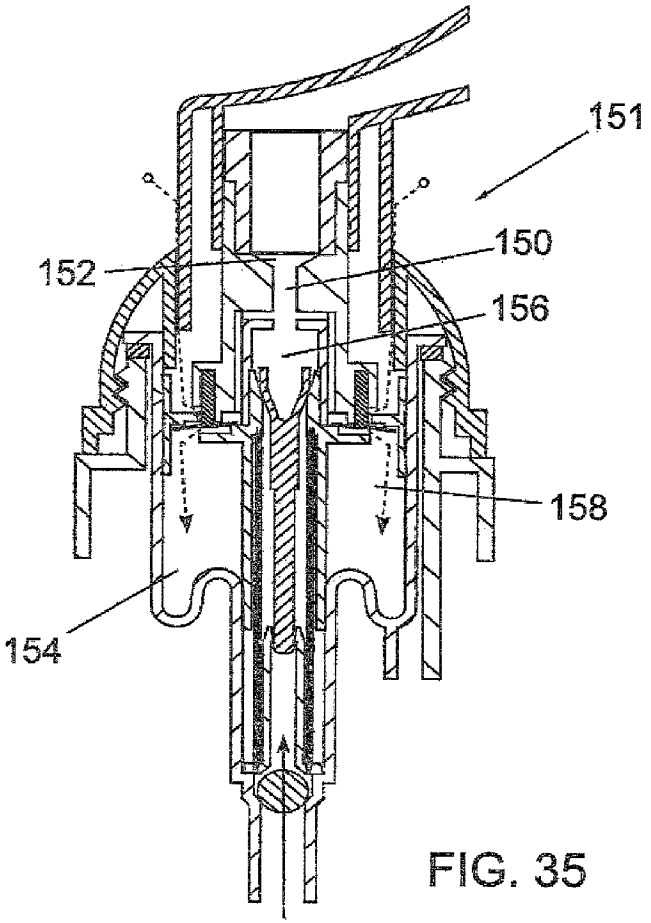
FIG. 35 is a sectional view of a modified version of the foaming assembly of FIG. 34 showing the air flow path and liquid flow path on the return stroke.

This foam assembly may be modified in a similar fashion as described above. For example it could be modified by inserting a mixing tube similar to those described above. Alternatively the foaming assembly 151 could be modified as shown in FIGS. 35 and 36. FIG. 35 shows the return stroke and FIG. 36 shows the activation stroke and wherein the dotted lines 158 show the air flow and the sold line 160 shows the flow of the liquid. Foaming assembly 151 is similar to the prior art foaming assembly 140 shown in FIG. 34 but with a modified mixing chamber and a reduced volume of air in the air chamber. The mixing chamber has a central elongate mixing channel 150 with an exit zone which herein is a chamfer 152 downstream thereof. The volume of the combined central elongate mixing channel 150 and chamfer 152 is approximately one quarter of the volume of the prior art mixing chamber 146. The improved mixing action allows the volume of the air chamber 154 to be reduced as compared to air chamber 142 by about 10 percent. The volumes of the liquid chambers 146 and 156 are similar. It will be appreciated by those skilled in the art that mixing tube described above could be molded separately as a mixing tube and then inserted into the mixing chamber in a foaming assembly or alternatively it could be formed as an integral part of the mixing chamber.

It has been observed that the mixing tubes 18, 112 and 130, and the central elongate mixing channel 150 combines the air and liquid in a more turbulent manner as compared to the prior art. it was observed that a ratio of 0.75 ml of liquid to 14.2 ml air yields a theoretical ratio of 1:18.9 but in the prior art device similar to that shown in FIG. 26 the observed result is generally 1:12. In contrast a ratio of 1.5 ml of liquid to 13.2 ml of air yields a theoretical ratio of 1:8.8 with an observed result of 1:8.1 in the embodiments shown in FIGS. 30 to 33. Accordingly the air to liquid volume ratio may be reduced from the prior art shown herein and thus more liquid per shot may be dispensed while maintaining the same packaging or dispenser size whilst also providing a commercially acceptable foam quality. The ratio of the volume of liquid to air may be between 1:2 and 1:12 or in specific applications it may be 1:8 and 1:9.

Figure 38:
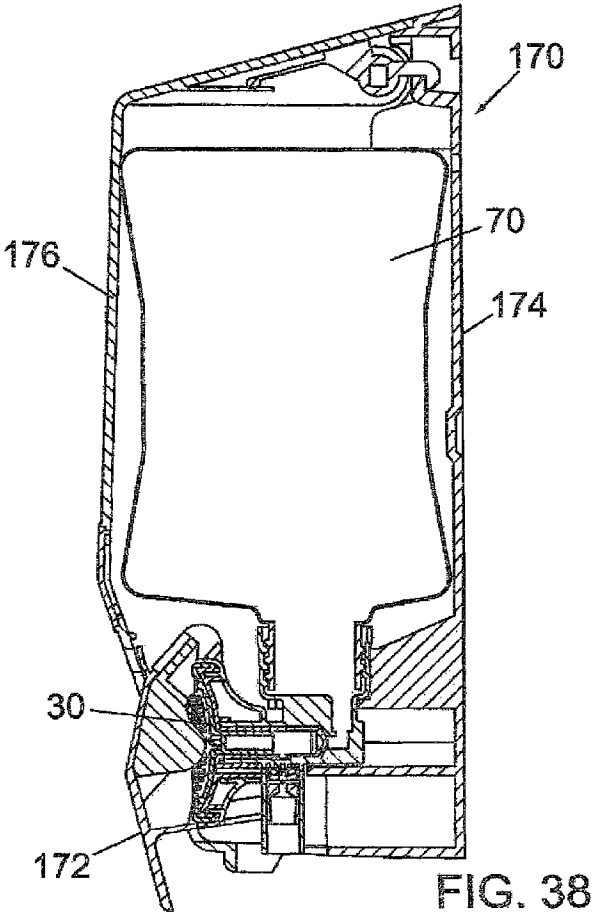
FIG. 38 is a sectional view of the foam dispenser and housing of FIG. 37 but showing the return stroke.
Figure 37:
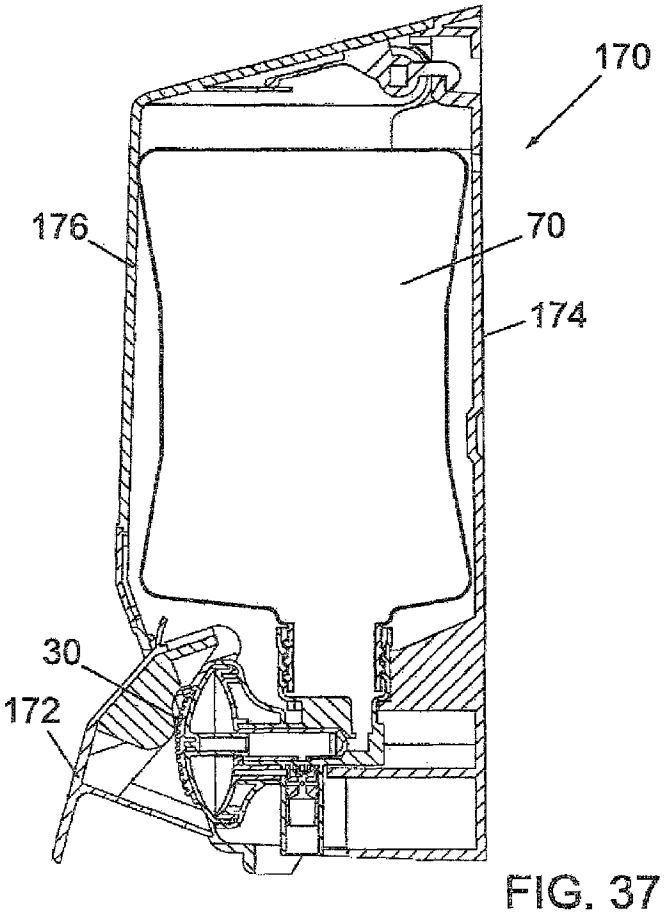
FIG. 37 is sectional view of the foam dispenser of FIGS. 16 to 21 in a dispenser housing.

It will be appreciated that the embodiments of foam dispensers shown herein may be used in association with a dispenser housing wherein the dispenser housing includes a push bar assembly that engages the piston dome by moving the push bar assembly enables the activation stroke of the piston dome. Further, the push bar may be activated manually or automatically wherein a motion sensor is operatively connected to the push bar assembly such that motion within a predetermined range of the motion sensor will activate the push bar assembly. An example of this is shown in FIGS. 37 and 38 which show a dispenser housing 170 used in conjunction with the foam dispenser 70 shown in FIGS. 16 to 20 and wherein FIG. 37 shows the push bar 172 in the at rest position ready for the activation stroke and FIG. 38 shows the push bar 172 pushing against the piston dome 30 and in the return stroke. it will be appreciated by those skilled in the art that the other embodiments could similarly be housed in a dispenser housing. Dispenser housing 170 includes a push bar 172 which pushes against the piston dome 30 of foam assembly 74. Dispenser housing 170 includes a back portion 174 and a front portion 176. Back portion 174 will typically be attached to a wall. Front portion 176 is attachable to back portion 174. Push bar 172 is hingeably attached to front portion 176. The embodiments of the foam dispensers described herein may be used with foamable liquid and in particular soaps, creams or other lotions that are capable of being foamed. Alternatively it may be used with a foamable alcohol.

Generally speaking, the systems described herein are directed to foam dispensers and improved insert. As required, embodiments of the foam dispenser and improved insert are disclosed herein. However, the disclosed embodiments are merely exemplary, and it should be understood that the foam dispenser and improved insert may be embodied in many various and alternative forms. The Figures are not to scale and some features may be exaggerated or minimized to show details of particular elements while related elements may have been eliminated to prevent obscuring novel aspects.

Therefore, specific structural and functional details disclosed herein are not to be interpreted as limiting but merely as a basis for the claims and as a representative basis for teaching one skilled in the art to variously employ the foam dispenser and improved mixing chamber. For purposes of teaching and not limitation, the illustrated embodiments are directed to foam dispensers.

As used herein, the terms "comprises" and "comprising" are to be construed as being inclusive and opened rather than exclusive. Specifically, when used in this specification including the claims, the terms "comprises" and "comprising" and variations thereof mean that the specified features, steps or components are included. The terms are not to be interpreted to exclude the presence of other features, steps or components.

What is claimed is:

1. A foam assembly connectable to a liquid container comprising:

a main pump body having an exit nozzle;

a piston dome attached to the main pump body, wherein the piston dome comprises a resiliently deformable dome and a liquid piston portion, and has an at rest position and a depressed position;

an air chamber defined by the piston dome and the main pump body;

a liquid chamber defined by the liquid piston portion and the main pump body and having a liquid inlet valve and a liquid outlet valve;

a mixing zone in flow communication with the air chamber and in flow communication with the liquid chamber; and a porous member in the exit nozzle downstream of the mixing zone; and whereby the volume of the air chamber is dependent on the position of the piston dome and volume of the liquid chamber is dependent on the position of the liquid piston portion of the piston dome and during an activation stroke the piston dome moves from the at rest position to the depressed position and responsively the volume of the air chamber and the volume of the liquid chamber are reduced.

2. The foam assembly of claim 1 wherein the main pump body includes a main pump body portion and a second pump body portion forming a liquid and air bore.

3. The foam assembly of claim 2 wherein the liquid inlet valve is integrally formed in the second pump body portion.

4. The foam assembly of claim 2 wherein the second pump body portion further includes an air path integrally formed therein wherein the air path extends between the air chamber and the mixing zone.

5. The foam assembly of claim 1 further including an air inlet valve in flow communication with the liquid container.

6. The foam assembly of claim 1 wherein the mixing zone includes an elongate mixing channel has an upstream end and a downstream end and the liquid chamber is in flow communication with the upstream end of the elongate mixing channel via the liquid outlet valve.

7. The foam assembly of claim 6 further including a chamfer at the downstream end of the elongate mixing channel whereby the chamfer expands in a downstream direction.

8. The foam assembly of claim 7 wherein the elongate mixing channel includes at least one air port spaced downstream from the upstream end of the elongate mixing channel.

9. The foam assembly of claim 8 further including a mixing tube and the elongate mixing channel, the chamfer and air ports are formed in the mixing tube.

10. The foam assembly of claim 8 wherein the at least one air port is four air ports equally spaced around the elongate mixing channel.

11. The foam assembly of claim 8 wherein the at least one air port is two air ports equally spaced around the elongate mixing channel.

12. The foam assembly of claim 1 further including a foam tube wherein the foam tube has the porous member attached to one end thereof.

13. The foam assembly of claim 12 wherein the foam tube has a second porous member attached to the other end thereof.

14. The foam assembly of claim 12 further including a second foam tube wherein the second foam tube has a second foam tube porous member attached to one end thereof.

15. The foam assembly of claim 1 wherein the liquid container is one of an upright liquid container, an inverted liquid container and an inverted pouch.

16. A foam dispenser comprising:

a liquid container;

a main pump body having an exit nozzle;

a piston dome attached to the main pump body wherein the piston dome comprises a resiliently deformable dome and a liquid piston portion, and has an at rest position and a depressed position;

an air chamber defined by the piston dome and the main pump body;

a liquid chamber defined by the liquid piston portion and the main pump body and having a liquid inlet valve and a liquid outlet valve;

a mixing zone in flow communication with the air chamber and in flow communication with the liquid chamber; and a porous member in the exit nozzle downstream of the mixing zone; and whereby the volume of the air chamber is dependent on the position of the piston dome and volume of the liquid chamber is dependent on the position of the liquid piston portion of the piston dome and during an activation stroke the piston dome moves from the at rest position to the depressed position and responsively the volume of the air chamber and the volume of the liquid chamber are reduced.

17. The foam dispenser of claim 16 wherein the main pump body includes a main pump body portion and a second pump body portion forming a liquid and air bore.

18. The foam dispenser of claim 17 wherein the liquid inlet valve is integrally formed in the second pump body portion.

19. The foam dispenser of claim 17 wherein the second pump body portion further includes an air path integrally formed therein wherein the air path extends between the air chamber and the mixing zone.

20. The foam dispenser of claim 16 further including an air inlet valve in flow communication with the liquid container.

21. The foam dispenser of claim 17 further including an air inlet valve in flow communication with the liquid container and wherein the air inlet valve is integrally formed in the second pump body portion.

22. The foam dispenser of claim 16 wherein the mixing zone includes an elongate mixing channel has an upstream end and a downstream end and the liquid chamber is in flow communication with the upstream end of elongate mixing channel via the liquid outlet valve.

23. The foam dispenser of claim 22 further including a chamfer at the downstream end of the elongate mixing channel whereby the chamfer expands in a downstream direction.

24. The foam dispenser of claim 23 wherein the elongate mixing channel includes at least one air port spaced downstream from the upstream end of the elongate mixing channel.

25. The foam dispenser of claim 24 further including a mixing tube and the elongate mixing channel and the chamfer are formed in the mixing tube.

26. The foam dispenser of claim 24 wherein at least one air port is four air ports equally spaced around the elongate mixing channel.

27. The foam dispenser of claim 24 wherein at least one air port is two air ports equally spaced around the elongate mixing channel.

28. The foam dispenser of claim 16 further including a foam tube wherein the foam tube has the porous member attached to one end thereof.

29. The foam dispenser of claim 28 wherein the foam tube has a second porous member attached to the other end thereof.

30. The foam dispenser of claim 28 further including a second foam tube wherein the second foam tube has a second foam tube porous member attached to one end thereof.

31. The foam dispenser of claim 16 wherein the liquid container is one of an upright liquid container, an inverted liquid container and an inverted pouch.

32. The foam dispenser of claim 16 further including a dispenser housing, the dispenser housing including a push bar for engaging the piston dome.

* * * * *